US006371346B1

(12) United States Patent
Sharma

(10) Patent No.: US 6,371,346 B1
(45) Date of Patent: Apr. 16, 2002

(54) INTERCHANGEABLE EQUIPMENT CARRIER SLING/WAIST BELT

(76) Inventor: Sanjiv Ranjan Sharma, 1555 Lakeside Dr., #161, Oakland, CA (US) 94612

( * ) Notice: Subject to any disclaimer, the term of this patent is extended or adjusted under 35 U.S.C. 154(b) by 0 days.

(21) Appl. No.: 09/324,361

(22) Filed: Jun. 2, 1999

Related U.S. Application Data

(63) Continuation-in-part of application No. 09/158,298, filed on Sep. 22, 1998, now abandoned, and application No. 08/987,126, filed on Dec. 8, 1997, now abandoned.

(60) Provisional application No. 60/098,391, filed on Aug. 29, 1998.

(51) Int. Cl.[7] ..... A45F 5/00

(52) U.S. Cl. ..... 224/578; 224/250; 224/257; 224/580; 224/195; 224/684; 224/917

(58) Field of Search ..... 224/250, 257, 224/258, 269, 660, 662, 663, 664, 667, 672, 676, 680, 191, 150, 917, 195, 264, 578–582, 907

(56) References Cited

U.S. PATENT DOCUMENTS 792,126 A * 6/1905 Freund ..... 224/250
4,237,583 A * 12/1980 Sullivan ..... 224/667 X
4,863,083 A * 9/1989 Chen ..... 224/250 X
4,898,310 A * 2/1990 Remington ..... 224/907 X
5,318,084 A * 6/1994 Jackson ..... 224/264 X
5,370,286 A * 12/1994 Newman ..... 224/257 X
5,437,401 A * 8/1995 Seltzer ..... 224/250 X
5,450,991 A * 9/1995 Neading ..... 224/257 X
5,465,888 A * 11/1995 Owens ..... 224/680 X
5,636,778 A * 6/1997 Jones et al. ..... 224/258 X
5,642,842 A * 7/1997 Tars ..... 224/258 X
5,690,261 A * 11/1997 Moore ..... 224/258 X
5,695,101 A * 12/1997 Frietze ..... 224/250

* cited by examiner

*Primary Examiner*—Gregory M. Vidovich

(57) ABSTRACT

The accessory is designed to interchange between a waist belt that is fully portable and a sling that can carry large or bulky equipment such as inline skates and snowboards. Hence, the accessory has a dual use nature. The accessory is composed of an elongated belt with connector members on opposite ends and two open and closeable cargo-carrying loops attached along the length of the belt. At least one of the cargo-carrying loops is attached to the belt via a sliding buckle. The sliding buckle can slide and lock the attached cargo-carrying loop to any available point on the elongated belt. Acting as a waist belt, the accessory is completely portable and allows the user to convert the accessory into an equipment-carrying sling at any alternative location. Acting as a sling, the accessory can be adapted into two different configurations. Both configurations use a shoulder of the user as a fulcrum in which to balance carded equipment. One configuration is optimized to carry equipment of a modular nature, such skates and boots. This configuration positions the elongated belt over a shoulder of the user with the attached cargo-carrying loops lying on opposite dorsal and ventral sides of the user. The other configuration is optimized to carry equipment of an elongated nature, such as snowboards or skateboards. This other configuration positions the elongated belt across the ventral side of the user's torso with the attached cargo-carrying loops lying on the dorsal side of the user.

18 Claims, 9 Drawing Sheets

INTERCHANGEABLE EQUIPMENT CARRIER SLING/WAIST BELT

CROSS REFERENCES

This application is a continuation-in-part application of the abandoned continuation-in-part application Ser. No. 09/158,298 filed Sep. 22, 1998 for the abandoned parent application Ser. No. 08/987,126.

This application relates to the continuation-in-part application Ser. No. 09/191,607 filed Nov. 13, 1998 to the design patent applications Ser. No. 29/088,446 filed May 22, 1998 that was related to the parent application Ser. No. 08/987, 126.

This application is the subject matter of provisional application Ser. No. 60/098,391 filed on Aug. 29, 1998.

BACKGROUND

1. Field of Invention

This invention relates to article carriers, and more specifically to a portable, adjustable, equipment-carrying device that can be transformed between a sling, for carrying large and awkward sized components, and a belt, for the easy transport of the device to alternate locations.

2. Discussion of Background Art

The task of transporting large, heavy, and/or awkward sized pieces of equipment to different locations is a problem faced by many. Additionally, many of today's recreational enthusiasts find that the equipment needed for a specific activity may be large, heavy, and/or awkward shaped. Many recreational activities require a specific area or setting where the equipment pertinent to the activity can be used. Accordingly, the user will have to transport her equipment from one location to the next. Furthermore, the equipment may need to be transferred to and from a series of different locations.

Modular equipment such as in-line skates are large, heavy, and stiff and include a multi-wheeled chassis extending from the sole of the skate boot. Steps, rough terrain, safety considerations, and regulatory reasons may present obstacles requiring the user to remove his or her skates. Consequently, the user has to carry his or her skates across or past any obstacles. Correspondingly, elongated equipment such as snowboards are long, wide, large, stiff, and heavy. Snowboards also have to be carded when they are not being used as vehicles for gliding across snow. For instance, activities including; climbing hills, walking through a parking lot or other non-snow surfaces, and navigating steps provide a sampling of the many situations requiring the carding of snowboards. Similarly, elongated skateboards are also long, wide, large, stiff and heavy. As with snowboards and inline skates, skateboards need to be carded in certain circumstances. As noted above these circumstances can either be of a physical or regulatory nature.

Generally, article carriers used to carry and hold awkward-sized equipment are designed to accommodate specific components. As a result, many carriers of large and/or awkward sized equipment have specific features in order to carry such articles. For instance, a carrier designed to transport a modular piece of equipment by enclosing it in a "pack" of sorts may not be appropriate for carrying objects of an elongated nature. Many standard backpacks are simply not large enough to stow unusually shaped equipment. Furthermore, carriers for specific equipment often lack a degree of universality that allow the users to carry a host of different and unrelated equipment loads. An equipment carrier that is portable and can carry a variety of awkward-shaped pieces is required.

A number of article carriers have been designed with the purpose of minimizing the effort required to manually carry heavy and awkward shaped equipment loads. Many of these carriers seek to strap the carded equipment to the user rather than enclose the equipment in a pack. Furthermore, many of these carriers include a main belt to fit around the waist of the user, thereby ensuring the portable nature of the carrier. However, there are certain features among these types of carriers that limit the different types of loads and users the carrier can accommodate. For instance, many of the carriers have their equipment attachment facilities statically positioned at opposite ends of the main belt. The fixed placements of such facilities limit the different conformations and hence the different equipment loads that the carrier can transport. In an attempt to make these carriers further adjustable, some of the carriers are composed of more than one strap making up their main belt. This mechanism provides two straps that move in opposite directions relative to each other, thereby increasing and decreasing the main belt length and the distance between the two equipment attachment facilities. The accoutrements that mediate the articulation of the two straps, tightly secure the straps to one another so that they will not come apart when carding loads. Hence, any adjustment in the accoutrements and straps often requires manual manipulation, which can be difficult, complicated, and time consuming. In addition, it is often difficult to accurately adjust the length of the main belt to any specific length. Many times the user will have to make an adjustment, physically test whether the adjustment is roughly correct and then rework the adjustment to gain a more accurate and desirable belt length. Furthermore, when the equipment attachment facilities and hence the ends of the carrier are drawn closer together, these carriers tend to create a lot of slack in at least one of the two straps composing the main belt. The slack or excess length in the main belt may be positioned on the user's dorsal side and thus may inadvertently catch on various obstacles.

U.S. Pat. No. 4,483,470 to Cousins discloses an article carrier specifically designed to carry modular components such as roller skates. This carrier provides a single strap composing the main belt with snapper-like clamp buckles disposed at each end thereof. The buckles clamp on a given portion of the carded skate. This type of attachment is not secure, limits the variety of objects that can be carried, and may even damage a carded load as it physically clamps down on the carded article. The carrier is slung over the shoulder of the user with one carded skate in front of the user and the other in back. This type of carrier allows the carded items to dangle freely, apart: from each other in a nonsecure manner. In this arrangement, the carried items can swing out and knock back into the user or fall off the user's shoulder completely.

U.S. Pat. No. 4,676,417 to Hirschkoff discloses an article carrier specifically designed to carry skis. The design consists of a two-strap mechanism with a plurality of equipment attaching loops at each end of the main belt. The loops are slidably attached to the main belt and can be drawn back from the ends thereby concealing the loops in a special pocket located at each end along the main belt. The loops are formed by hook and loop material placed on adjacent flexible straps. This material tends to wear quickly when exposed to heavy loads and come apart when exposed to certain sheering forces. As the loops are placed at opposite ends of the main belt, the number of different conformations the devise can adapt to is necessarily limited. The plurality of loops, including the hook and loop material between the members composing the loops, will undoubtedly create a bulky mass. The bulky mass of equipment attaching loops may interfere in sliding them in and out of specialized pockets. The device operates by carrying ski equipment along side the user with the equipment secured to the user around the shoulder in a purse-like fashion. As noted earlier, the Hirschkoff device employs a two-strap mechanism and is prone to some of the aforementioned disadvantages associated with such a design. Although these carriers free at least one hand of the user, they position the object at an angle that is perpendicular to the user. Elongated equipment carried in this manner can knock into objects in front and back of the user. In addition, when the user turns around in a circle, the carded equipment lying perpendicular to the user will take up a significant amount of area. The risk of injury to other individuals is increased especially in crowded situations.

U.S. Pat. No. 4,863,083 to Chen discloses a portable device for carrying both modular components such as ski boots and elongated components such as skis. This device is composed of a single main belt with equipment attachment loops slidably attached to the main belt. Similar to U.S. Pat. No. 4,676,417 to Hirschkoff, the carrying loops in the Chen device are formed by hook and loop self-gripping material. And like the former, encounters the same problems when exposed to heavy loads. The Chen device, however, configures the carrier to carry equipment around the waist of the user. Both modular and elongated equipment hangs from the user's waist while employing this carrier. This method of transportation can be uncomfortable for the user as a walking motion will result in the user's legs bumping into the equipment dangling off the user's waist. In addition, carded elongated equipment still requires the user's hand to stabilize the load. Hence the utility of the carrier is diminished, as the user is required to use his/her hands in conjunction with the carrier to support carded loads. Furthermore, this carrier places all the weight of the carded equipment around the waist of the user. This area on the human body does not bear carded weight loads as well as other areas like the shoulders.

U.S. Pat. No. 5,370,287 to Newman discloses a portable device for carrying a variety of differently shaped objects. The design consists of a two-strap mechanism with equipment attaching loops mounted at each end of the main belt. In addition to aforementioned disadvantages associated with such a design, the loops are limited in the method of articulation with carded equipment. The loops are adjustable in diameter and utilize a snapper buckle and a D-ring to wrap around carded objects. This design precludes the possibility of the loops securing equipment by articulating with a hole or aperture included in the equipment. The design would require the user to thread the snapper buckle through such apertures. This snapper buckle may be too large to fit through such apertures. The accessory also utilizes the snapper buckles to form an enclosed belt around the waist of the user when the accessory is not being actively used. As with U.S. Pat. No. 4,483,470 to Cousins, the snapper hooks are generally not designed to secure a belt around the waist of a user as tightly or comfortably as standard belt buckles. Furthermore, the Newman device utilizes four different slides point to adjust both the included straps and loops. These slides can not only complicate any required adjustments to the accessory, but also require manual manipulations involving both of the user's hands. This manual manipulation is not easy and often can be time consuming.

U.S. Pat. No. 5,603,545 to Benson et al discloses an article carrier designed for carrying a variety of differently shaped objects. The design consists of a one-strap mechanism with cargo attaching loops at each end of the main belt. Although, the Benson device uses only a single strap composing the main belt, thereby simplifying its use and adjustment, the device statically positions the cargo attaching loops at each end of the main belt, thereby limiting the number of different equipment loads the device can carry. The cargo attaching loops are designed to quickly and easily open and close around a variety of objects. The device further includes the ability of the encircling loops to self-tighten around carded objects. However, like U.S. Pat. No. 5,370,287 to Newman, the Benson device utilizes securing accoutrements on the cargo attaching loops that are large. These large accoutrements may narrow the possibility of the cargo attaching loops to secure any particular equipment by articulating with a hole or aperture included in the equipment. Hence, these devices are also limited in the number of different ways in which they can bind to the carded object. Heavy, elongated objects carried in an upright manner may potentially slip through the cargo attaching loops formed only around the carded object.

U.S. Pat. No. 5,450,991 to Neading discloses an article carrier specifically designed to carry skis. The design consists of a two-strap mechanism with equipment attaching loops at each end of the main belt. Like U.S. Pat. No. 4,676,417 to Hirschkoff, the Neading device includes loops that are formed by hook and loop material placed on adjacent flexible straps and hence is prone to the same disadvantages of the former. Furthermore, as the loops are fixedly attached to the ends of the main belt, the different conformations and equipment loads available to the carrier are limited. As noted earlier, the Neading device includes a two-strap mechanism composing the main belt. This two-strap mechanism adds certain adjustment features to the device. However, this type of adjustment can be complicated and is often difficult to obtain an accurate adjustment on the first try. For instance, if the user wishes to transport the carrier around his or her waist, the user will have to adjust the positioning of the two straps, rather than simply pulling extra slack from the belt as it is tightened around the waist of the user. Like U.S. Pat. No. 5,370,287 to Newman, this adjustment of the two straps requires manual manipulation, which is not easy, and often time consuming due to the multiple attempts required to make the proper adjustment.

Consequently, a need still exists for a carrier device, which will overcome the drawbacks of prior universal carriers. The ideal carrier should easily attach to a variety of heavy, large, and/or awkward shaped pieces of equipment in a manner that is comfortable and secure. Such a cadre should also be easily adjustable to fit a variety of users, and fully portable as to allow the use of the cadre at several alternative locations. Furthermore, the incorporation of a storage option for stowing unrelated personal affects such as keys and wallets would even further increase the functionality of the ideal carrier.

OBJECTS AND ADVANTAGES

The accessory, an interchangeable equipment carrier sling/waist belt, provides an interchangeable belt and sling to carry equipment of a modular or elongated nature. Accordingly, several objects and advantages are derived from the accessory. One advantage of the present invention is its interchangeable nature. The accessory can adapt to two different conformations. The conformations having different utility, effectively impart a dual use feature to the accessory. The conformations are designated as contracted and extended. In the extended conformation, the present invention acts as a sling to carry various pieces of equipment. In the contracted conformation, the accessory acts as a waist belt. This waist belt is completely portable and eliminates the need to find a storage facility to stow the present invention when it is not being used as a sling (in the extended conformation).

Accordingly, several of the objects and advantages of the interchangeable equipment carrier sling/waist belt are as follows:

(a) To provide a sling that uses the shoulder as a fulcrum to balance the carded weight.

(b) To provide a carrier system for bulky awkward objects such as skates and snowboards yet leave space on the user to carry other goods. The user employing the present invention can still equip him/her self with other additional accessories for carrying other cargo, (i.e. a backpack).

(c) To provide a sling to carry bulky and/or heavy modular objects, such as skates and the like. The sling is configured such that one skate hangs on the front or ventral side of the user and the other skate hangs on the back or dorsal side of the user. This arrangement keeps the skates in the walking plane of the user, and does not add any extra width to the user such that it would impede his or her movement through normal or narrower thoroughfares. Additionally, the sling configured as such will also carry singular items like a grocery bag along the side of the user.

(d) To provide a sling equipped with stabilization strap. The stabilization strap connects each side (dorsal and ventral) of the sling together. The strap serves to restrict the distance that the carded articles can stray from each other and the user. Thus this strap minimizes the possibility that the carried articles will swing out and knock back into the user or fall off the user's shoulder completely.

(e) To provide a sling to secure equipment of an elongated nature such as a snowboard to the user's back. The sling articulates with the snowboard such that the bottom surface of the snowboard is strapped to the back of the user in an upright fashion.

(f) To provide a waist belt capable of being transported around the user's waist. Hence, in the contracted conformation, the need to stow the article carrier when it is not being utilized as a sling (in the extended conformation) is eliminated.

Additional components can be added to the interchangeable equipment carrier sling/waist belt that would increase the functionality of the present invention.

A modified shoulder pad is one such additional component, which can be mounted on the interchangeable equipment carrier sling/waist belt. The modified shoulder pad consists of a storage bag attached to a shoulder pad. Accordingly, several additional objects and advantages of the interchangeable equipment carrier sling/waist belt will become available when the modified shoulder pad is attached to the present: accessory and are as follows:

(a) To provide the accessory with a mounted storage bag. This storage bag will stow the user's personal effects such as wallets, keys, personal stereos, etc.

(b) To provide a shoulder pad on the sling, which will ease the burden of weight, placed on the user's shoulder.

(c) To provide a storage facility which is both accessible and useable in either the extended or contracted conformations of the accessory.

(d) To provide a widened area on the shoulder pad. When the accessory is worn as a waist belt, this widened area is positioned at the user's back around the waist region, and helps stabilize the accessory so that it does not circularly shift around the user's waist.

Secondary equipment securing mechanisms are another component, which can be mounted on the interchangeable equipment carrier sling/waist belt. The secondary equipment securing mechanisms, consisting of both a self-overlapping strap and a two slotted slider buckle, are perpendicularly attached to the interchangeable equipment carrier sling/waist belt. Accordingly, some additional objects and advantages of the interchangeable equipment carrier sling/waist belt become available when the secondary equipment securing mechanism is attached to the present invention and are as follows:

(a) To provide additional securing means for carrying extra equipment. Additional equipment can be carded by articulating the flexible strap wrath an integral aperture inherent to the equipment. For example, when the user is required to remove his or her skates, the user will require a pair of walking shoes to further protect the his or her feet. Walking shoes and other equipment, such as a baseball cap or helmet, possessing an integral aperture can be secured in such a fashion and are thus hung from the belt of the interchangeable equipment carrier sling/waist belt.

(b) To provide additional securing means for carrying extra equipment. Additional equipment can be carded by synching down the flexible strap around the carded object. Hence, a pair of these securing mechanisms can secure equipment such as a pair of shoes stacked upon one another, a blanket, or a jacket. Each secondary equipment securing mechanism wraps around one end of the carded object.

Figures 1A, 1B:
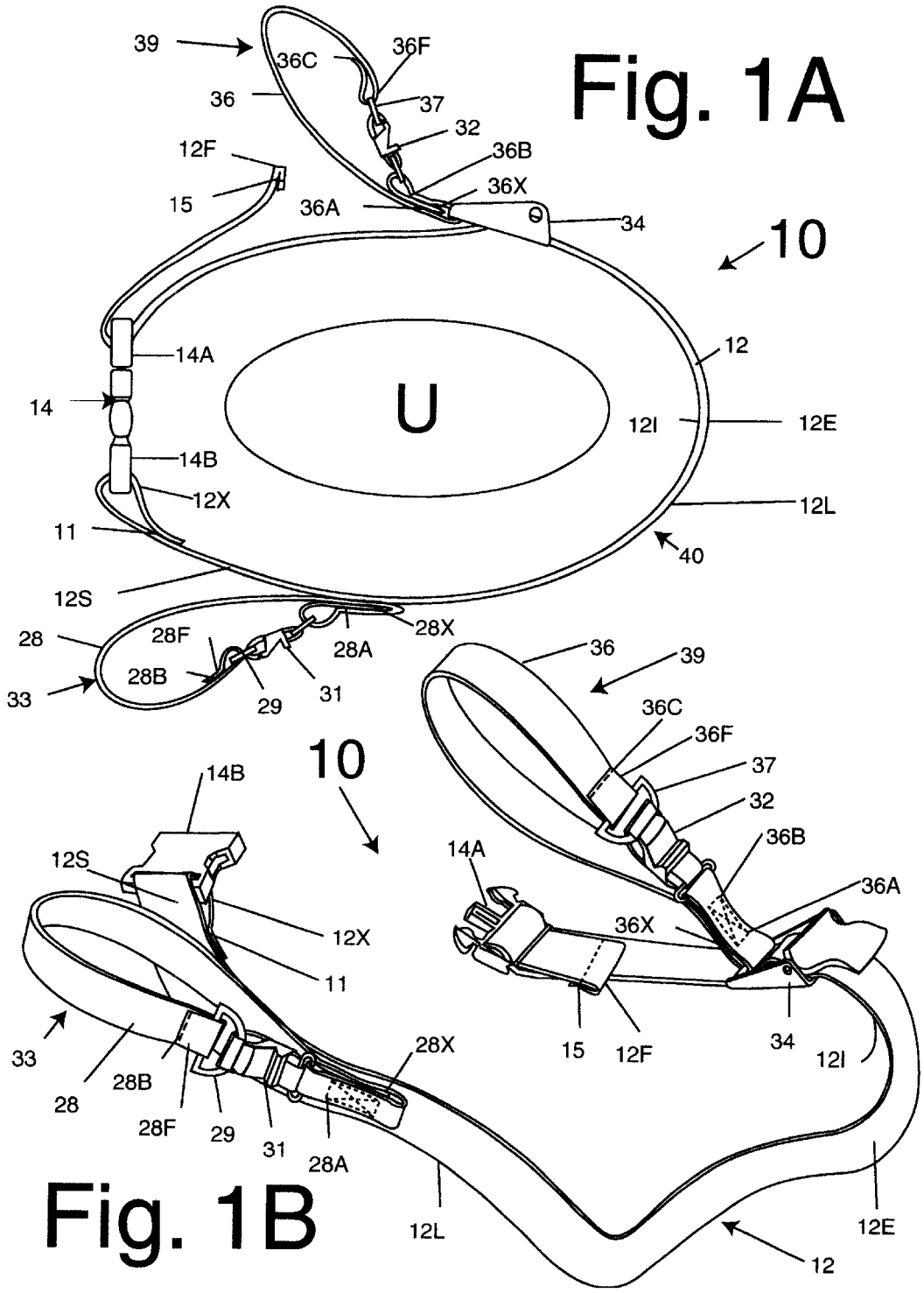
FIG. 1A is a top perspective view of the accessory with the belt ends connected.
FIG. 1B is an angle perspective view of the accessory with the belt ends disconnected.

Reference numerals in drawings:

The INTERCHANGEABLE EQUIPMENT CARRIER SLING/WAIST BELT—10—the Accessory.

Sewn bend 11
Belt 12
Interior surface 12I
Exterior surface 12E
Free end 12F
Fixed end 12X
Short portion 12S
Long portion 12L
Releasable securing 14 connectors
Male connector 14A
Female connector 14B
Sewn bend 15
Modified shoulder pad 17
Front side 17A
Back side 17B
Storage bag 18
body portion 18A
lid portion 18B
Conventional zipper 18C
Anchor strap 18D
Shoulder pad 19
Widened area 19A
Stabilization end 19B
Free end 19C
Anchor strap 19D
Secondary equipment 20 securing mech.
Slider buckle 23
Flexible strap 24
Free end 24F
Fixed end 24X
Short arm 24S
Long arm 24L
Fastening material 27
Closed loop 25
Load-bearing strap 28
Sewn bend 28A
Sewn bend 28B
Free end 28F
Fixed end 28X
D-ring 29
Snapper-like buckle 31
Snapper-like buckle 32
Cargo-carrying loop 33
Modified cam buckle 34
First slot 34A
Second slot 34B
Load-bearing strap 36
Sewn bend 36A
Sewn bend 36B
Sewn bend 36C
Free end 36F
D-ring 37
Fixed end 36X
Cargo-carrying loop 39
Enclosed belt 40

SUMMARY

An interchangeable equipment carrier sling/waist belt provides a dual use accessory. The accessory is designed to interchange between two independently functioning conformations. The conformations are designated as contracted and extended. In the contracted form the accessory acts as a waist belt. The waist belt is completely portable and can be securely stowed around the user's waist. In the extended conformation, the accessory acts as a sling. The sling can be arranged on the user in two different configurations. One configuration is designed to carry principally modular components. This configuration of the sling can be stabilized on the user's shoulder by the formation of a stabilization strap that connects under the shoulder opposite the shoulder bearing the sling. The other configuration is designed to carry principally elongated components. Both configurations utilize a shoulder of the user in the balancing and carrying of the carded equipment. Furthermore, the addition of elements such as a storage bag and additional securing means to the present invention, allow the user to stow personal effects in addition to carrying more bulky equipment.

The frame of the interchangeable sling/waist belt is an elongated belt made of flexible material such as webbing. This webbing can be used to compose various loops and straps throughout the accessory. The belt has two opposite sides and ends. The opposite ends can be reversibly connected to one another through the use of known securing means. Preferably the ends of the belt are reversibly connected through the use of a pair of mateable connector members, commonly known as quick release buckles. These members connect to form the waist belt and stabilization strap as mentioned above.

Two cargo-carrying loops are attached to the belt. These cargo-carrying loops will be used to secure carded equipment in the extended conformation. The straps composing the cargo-carrying loops extend out and reversibly connect back to the point where they are attached to the belt. Mateable coupling members at each end of the strap mediate this reversible connection. The mateable coupling members are commonly known as a snapper buckle and a D-ring. This arrangement forms the cargo—carrying loops, which are capable of being opened and closed by a snapper-like closure and a D-ring. Alternatively, the strap end containing the D-ring can be folded back on itself forming a loop. This loop can be used in place of the D-ring for securing a snapper-like buckle such as a carabiner.

The cargo-carrying loops are both attached to the same side of the belt such that they are in the same plane as or parallel to the belt. The first of the two cargo-carrying loops is attached to the belt decidedly near one end of the belt. This attachment divides the belt into a long and short portion. The second cargo-carrying loop is attached to the long portion via a position lockable sliding device. This position lockable sliding device can be moved and locked to any available position along the long portion of the belt. Thus the second cargo-carrying loop can be moved and secured to any available position along the long portion of the belt. This sliding device allows the user to adjust the position of the cargo-carrying loop as desired. In the extended conformation, this sliding device effectively allows the user to customize the sling to his or her specific dimensions.

The interchangeable sling/waist belt in the extended conformation is used as a sling and the belt is worn over a shoulder of the user. The sling can be optimized for two different configurations with respect to the user. A first configuration is optimized to carry equipment of a modular nature such as inline skates or grocery bags. In this configuration, the sling balances, holds, and carries modular objects on the back or dorsal and front or ventral side of the user. As the cargo-carrying loops are used to attach carded equipment along the length of the belt and hence the sling, the opposite ends of the belt are free to be used as a stabilization strap. This stabilization strap is formed through the connection of the male and female connector members at each end of the belt. This connection occurs under the shoulder opposite to the shoulder bearing the sling. Furthermore, a singular modular item like a suitcase can be carded in this fashion. In this instance the singular modular object is connected to the sling through both cargo-carrying loops. The single modular objects hangs at the lateral side of the user.

A second configuration of the accessory in the extended conformation is optimized to carry equipment of an elongated nature such as a snowboard or a skateboard. In this configuration, the sling connects to the elongated object positioned on the dorsal side of the user and then runs over a shoulder of the user and continues at an angle across and down the ventral side of the user's torso. The sling then "crosses back" around the user, to the user's dorsal side and again connects with the elongated object through the second cargo-carrying loop. This "cross back" of the sling occurs at the user's side under the shoulder opposite to the one bearing the sling.

Other elements, which add extra functionality, can be attached to the belt composing the frame of the accessory. Two such elements are disclosed here as adding extra functionality. These elements are described as a modified shoulder pead and a secondary equipment securing mechanism. These elements are not necessarily mutually exclusive. Hence the added elements can be employed on the accessory either singularly or in tandem.

The modified shoulder pad is comprised of a storage bag attached to a shoulder pad. The primary function of this element is to provide both padding to the user's shoulder as well as a storage facility for the user's personal items. The shoulder pad is composed of cushioning material such as a foam core covered with a durable fabric. The modified shoulder pad is mounted along the long section of the belt with one end extending into the bordering short section. Additionally, the shoulder pad includes a widened area at its midpoint. When the interchangeable sling/equipment carrier is used as a waist belt, the integral widened area of the shoulder pad is positioned at the user's back and near the waist. This widened area prevents the interchangeable equipment carrier sling/waist belt from rotating or moving circularly around the user's waist. The storage bag component is also made from durable fabric. The storage bag portion of the modified shoulder pad is of known design and is used in accessories commonly known as fanny packs. The storage bag is positioned on the accessory such that it is readily accessible and can be used in both the contracted and extended conformations.

Another element, which adds functionally to the interchangeable equipment carrier sling/waist belt is the secondary equipment securing mechanism. The attachment of a pair of secondary equipment securing mechanisms, enables the interchangeable equipment carrier sling/waist belt to hold and carry extra equipment, such as shoes, a baseball cap, or a blanket. Each secondary equipment securing mechanism is composed of an overlapping flexible strap and a double slotted slider buckle. One end of the flexible strap is attached to one slot of the slider buckle. Each flexible straps has self-complimentary fastening material secured and available along its length. The fastening material is secured to one side of the flexible strap such that the flexible strap can fold over itself and releasably attach to itself by the overlap of the fastening material. There are several securing means available, which are capable of mediating this overlapping attachment. Preferably this attachment is mediated by hook and loop material. The secondary equipment securing mechanisms are mounted along the long section of the belt in a perpendicular fashion. The flexible straps composing each secondary equipment securing mechanism extend away from the belt perpendicular to and in opposite directions. The mechanism is operable by threading one end of the included flexible strap through the available slot in the slider buckle and then securing the flexible strap to itself by folding the flexible strap back on itself. Hence, the loops formed from the overlapping articulation of these straps are perpendicularly opposed to the attached belt. These loops can be used to secure secondary equipment by articulating with an aperture integral to the carded equipment, or by forming a tightened loop around the carded equipment. The secondary equipment securing mechanisms can be added to the present invention either with or without the addition of the modified shoulder pad.

DESCRIPTIONS

FIGS. 1–5

Referring to the drawings, and particularly to FIG. 1A, there is illustrated an interchangeable equipment carrier sling/waist belt, generally designated 10, being constructed and convertible between dual uses in accordance with the present invention. Hereinafter, for the sake of brevity, the interchangeable equipment carrier sling/waist belt 10 will simply be referred to as the accessory 10.

Referring to FIG. 1A, the frame of the accessory 10 is composed of an elongated belt 12 made of flexible material such as webbing. This flexible material is used throughout the accessory 10, to construct various loops, belts, and straps. The belt 12 is composed of two opposing surfaces and ends; an interior surface 12I, an exterior surface 12E; a fixed end 12X, and a free end 12F. The ends of the belt 12 can be releasably secured to one another through the use of a releasable securing connector 14. Such connectors can take the form of a belt buckle at one end and corresponding attachment facilities on the other end. This articulation of the releasable securing connector 14 provides an enclosed belt 40, which can be adjusted in diameter.

Referring to FIG. 1B, preferably, the releasable securing connector 14 takes the form of a pair of mateable connector members commonly known as a quick release buckle. The buckle is composed of a male connector 14A and a female connector 14B. The male and female connector members 14A, 14B per se, have a known design. The male connector 14A has a pair of flexible and manually depressible opposing latch fingers. The female connector member 14B has a pair of opposing notches in which the opposing latch fingers of male connector member 14A can insert and lock. In such manner, the male connector member 14A and female connector member 14B can either be interfitted and connected or withdrawn and disconnected from one another. The female connector member 14B is attached to the fixed end 12X of the belt 12 by a sewn bend 11 in the flexible material composing the belt 12. The male connector member 14A is secured in such a fashion that it can adjustably slide along the available length of the belt 12. The free end 12F of the belt 12 is threaded through the integrally associated ladderlock portion of the male connector 14A. Thus, male connector member 14A is allowed to move along the unobstructed length of belt extending through its integrally associated ladderlock portion. The free end 12F is folded back on itself forming a sewn bend 15. Similarly, like the male connector 14A, the female connector member 14B at the opposite end of belt 12 can be adjustably attached to the belt 12 by the inclusion of a ladderlock portion integral to the buckle.

Referring to FIG. 1A and 1B, a load-bearing strap 28 is attached to the exterior surface 12E near one end of belt 12. A fixed end 28X, of load-bearing strap 28, marks the attachment of load-bearing strap 28 to the belt 12. This attachment defines a short and long portion, 12S and 12L respectively, on the belt 12. The short portion 12S of belt 12 extends between the fixed end 12X and the attachment point of the load-bearing strap 28. The long portion 12L of belt 12 extends from the attachment point of the load-bearing strap 28 to the free end 12F. The attachment of load-bearing strap 28 to the belt 12 positions the load-bearing strap 28 parallel to or in the same geometric plane as the belt 12. A sewn bend 28A at the fixed end 28X of the load-bearing strap 28 creates an integral loop that secures a snapper-like buckle 31. The other opposite end, a free end 28F is left unattached to the belt 12. A sewn bend 28B at the free end 28F of the load-bearing strap 28 secures a D-ring 29 or similar enclosed coupling member. Alternatively, the integral loop created by the sewn bend 28B can serve as an enclosing coupling member. The free end 28F can be folded back and connected to the fixed end 28X. This connection is reversible and is mediated by the snapper-like buckle 31 and the D-ring 29 secured at each end of the load-bearing strap 28 by the sewn bends 28A and 28B respectively. A cargo-carrying loop 33 is formed from the load-bearing strap 28 when the D-ring 29 is connected with the snapper-like buckle 31.

A position lockable slider, known as a modified cam buckle 34, is allowed to slide along the length of the long portion 12L of belt 12. A load-bearing strap 36 is attached to the exterior surface 12E of the belt 12 via the modified cam buckle 34. The attachment of load-bearing strap 36 to the modified cam buckle 34 positions the load-bearing strap 36 parallel to or in the same geometric plane as the belt 12. The load-bearing strap 36 is attached to the modified cam buckle 34 at a fixed end 36X. The fixed end 36X is folded over itself twice forming a sewn bend 36A and a sewn bend 36B. The sewn bends 36A and 36B are adjacently positioned and point in opposite directions. The integral loop created in the sewn bend 36A secures the load-bearing strap 36 to the modified cam buckle 34. The integral loop created in the sewn bend 36B secures the load-bearing strap 36 to a snapper-like buckle 32. The other opposite end, a free end 36F of load bearing strap 36 is left unattached to the belt 12. A sewn bend 36C created at the free end 36F of the load-bearing strap 36 secures a D-ring 37 or similar enclosed coupling member. Again, as in sewn bend 28B, the integral loop created by the sewn bend 36C can serve as an enclosed coupling member. The free end 36F can be folded back and connected to the fixed end 36X. This connection is reversible and is mediated by the snapper-like buckle 32 and the D-ring 37 secured at each end of the load-bearing strap 36 by the sewn bends 36A and 36C, respectively. A cargo-carrying loop 39 is formed when the D-ring 37 is connected to the snapper-like buckle 32.

Figure 2A:
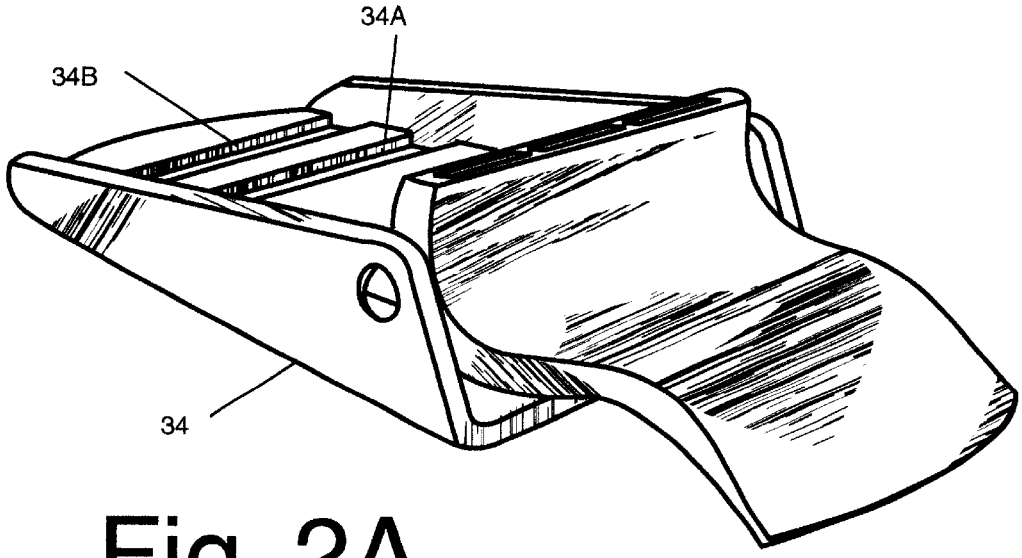
FIG. 2A is an angled perspective view of the modified cam buckle with the lever open.

Referring to FIG. 2A, the modified cam buckle 34 differs from standard cam buckles in that it is not utilized to articulate two ends of a belt but rather it is utilized as a position lockable sliding device. Accordingly there are modified features built in to the modified cam buckle 34. Namely, these features take the form of a first and second slot 34A and 34B respectively. These slots are elongated apertures located on the bottom surface of the modified cam buckle 34.

Figure 2B:
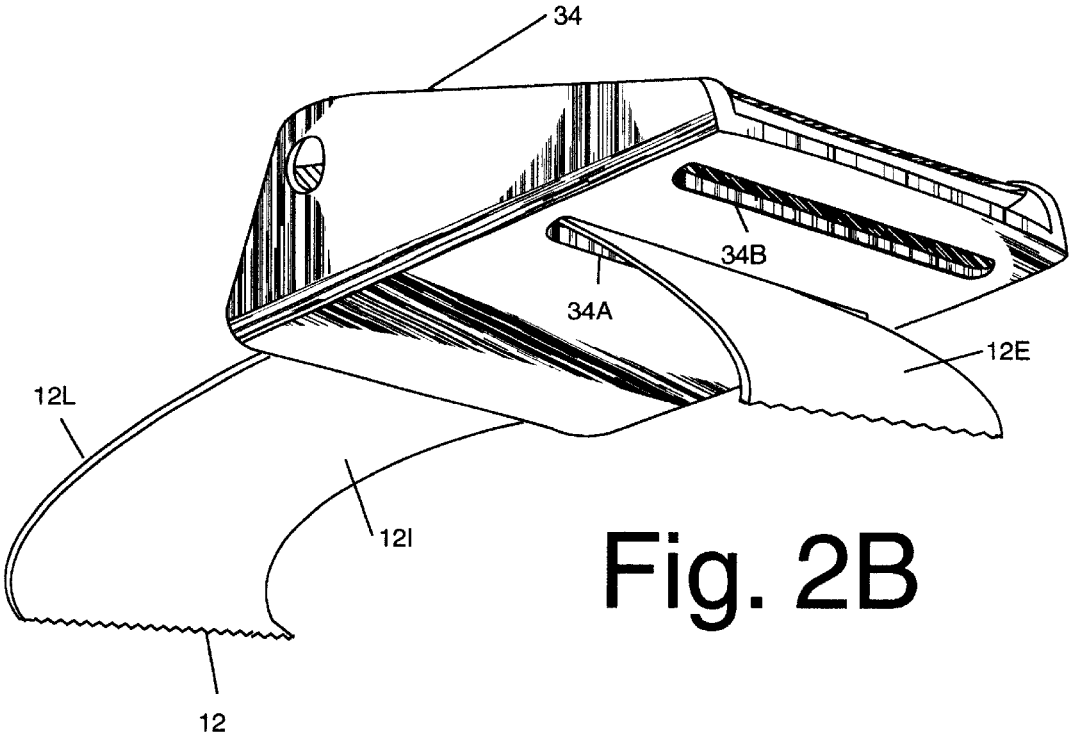
FIG. 2B is an angled perspective view of the modified cam buckle mounted on the belt.
Figure 3:
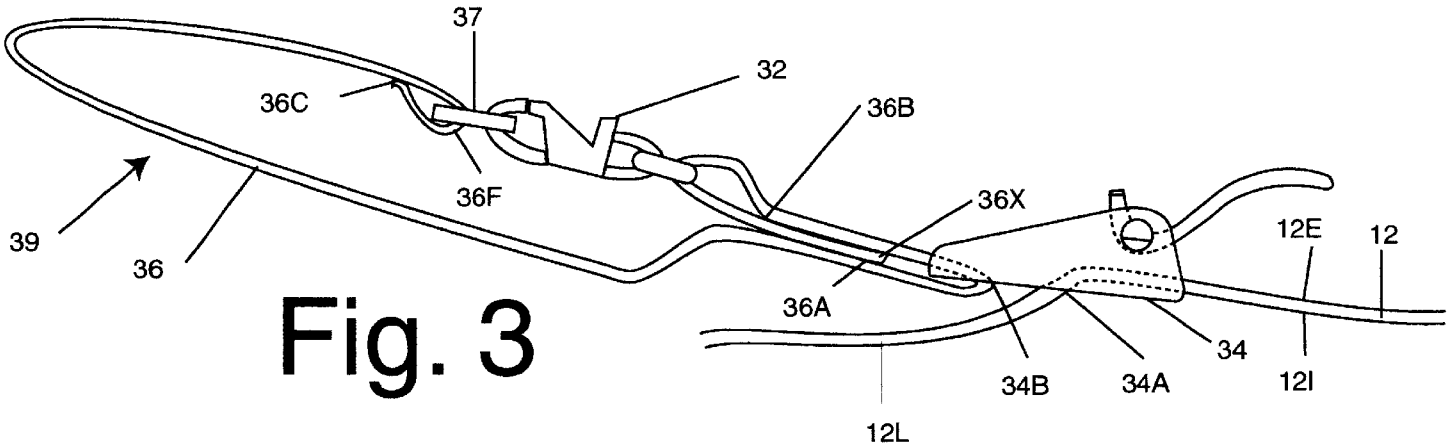
FIG. 3 is a side perspective view of the modified cam buckle mounted on the belt and connected to a cargo-carrying loop.

Referring to FIGS. 2B and 3, as in a standard cam buckle, the belt 12 enters the modified cam buckle 34 and runs through the body. However, instead of running out the rear portion, the belt 12 is diverted out the bottom of the modified cam buckle 34 by the first slot 34A. This arrangement allows the belt to reversibly slide through the modified cam buckle 34. Thus the modified cam buckle 34 can be moved along the unobstructed length of the long portion 12L of belt 12. The modified cam buckle 34 can also be clamped down and rendered immobile along any available point on the long portion 12L of belt 12. A second slot 34B is located just behind the first slot 34A, towards the rear of the modified cam buckle 34. Hence, the second slot 34B is located on the exterior surface 12E side of the long portion 12L of belt 12.

Referring to FIGS. 4, 5, 6, 9A, and 9B, as noted earlier, there are certain additional elements, which add extra functionality to the accessory. Two such additional elements are described here. These elements take the form of a modified shoulder pad 17 and a secondary equipment securing mechanism 20. The addition of these elements is not mutually exclusive. Both additional elements can be deployed and utilized on the accessory concurrently or singularly.

Figure 9A:
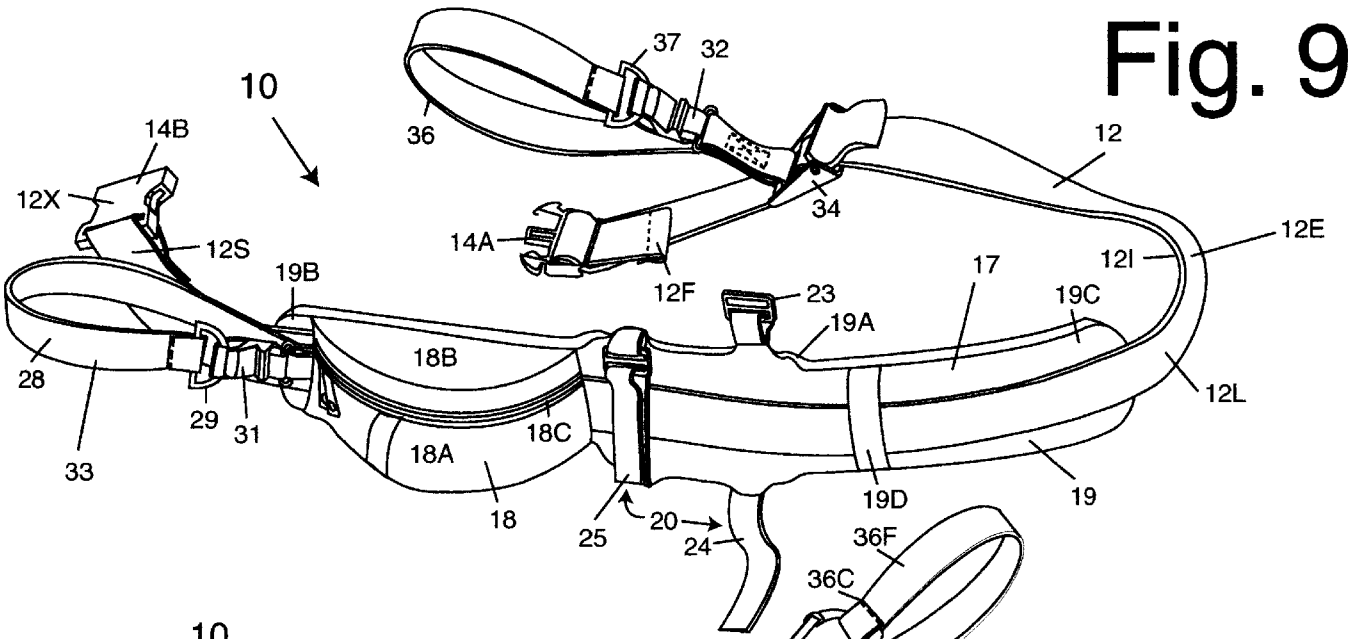
FIG. 9A is an angled perspective view of the modified shoulder pad mounted on the accessory to optimize configuration A.

Referring to FIG. 9A, the addition of the modified shoulder pad 17 adds some new functions and components to the accessory 10. The modified shoulder pad 17 is composed of two components; a shoulder pad 19 and a storage bag 18. The shoulder pad 19 is the main component and makes up the body of the modified shoulder pad 17. The shoulder pad 19 has two opposite ends; a stabilization end 19B and a free end 19C, and incorporates a widened area 19A at its midpoint. Preferably, the shoulder pad 19 consists of a foam core with a covering made of durable fabric. The storage bag 18, also made of durable fabric, is mounted on top of shoulder pad 19 and in between the stabilization end 19B and the widened area 19A. An anchor strap 19D is perpendicularly attached, by stitching points at each end thereof, between the free end 19C and widened area 19A of shoulder pad 19.

Figure 9B:
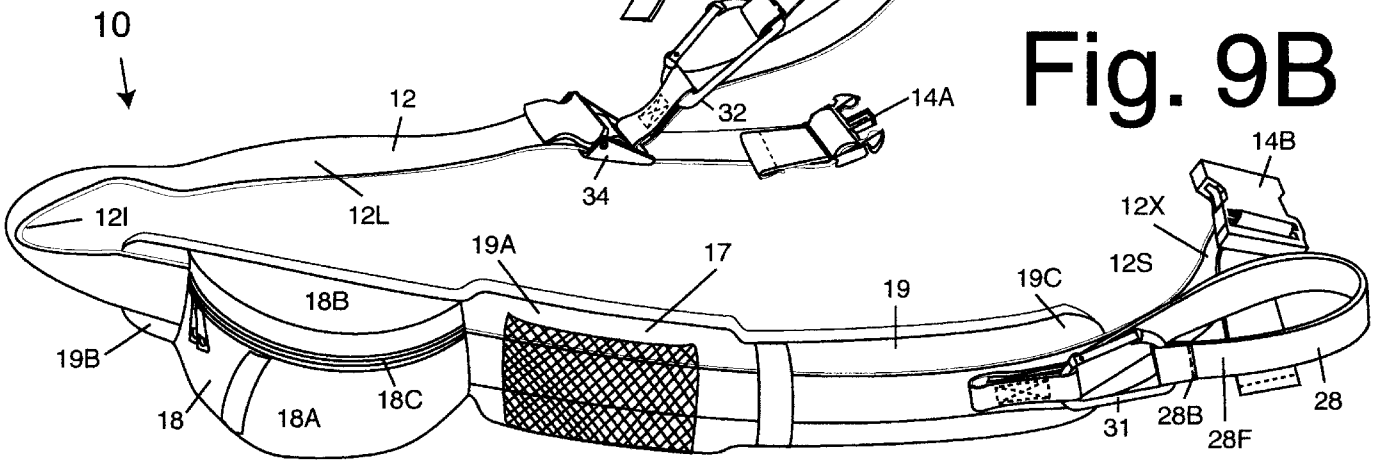
FIG. 9B is an angled perspective view of the modified shoulder pad mounted on the accessory to optimize configuration B.

Referring to FIGS. 9A and 9B, the modified shoulder pad 17 is mounted substantially near the fixed end 12X of belt 12. The modified shoulder pad 17 can be mounted on belt 12 in two different arrangements. Referring to FIG. 9A, one arrangement, positions the storage bag 18 next to the load-bearing strap 28 on the long portion 12L of the belt 12, with the adjacent stabilization end 19B extending into the short portion 12S of belt 12. Alternatively, referring to FIG. 9B, the modified shoulder pad 17 can be mounted with the opposite free end 19C extending into the short portion 12S of the belt 12 and storage bag 18 positioned near the mid point of the belt 12.

Referring back to FIG. 4, the modified shoulder pad 17 has a front and back side 17A and 17B respectively. The front side 17A faces away from the user (U) and the back side 17B faces the user (U). The modified shoulder pad 17 is mounted on belt 12 such that the entire shoulder pad 19 lies on the interior surface 12I of belt 12 and the storage bag 18 is mounted on the exterior surface 12E of belt 12.

Figure 5:
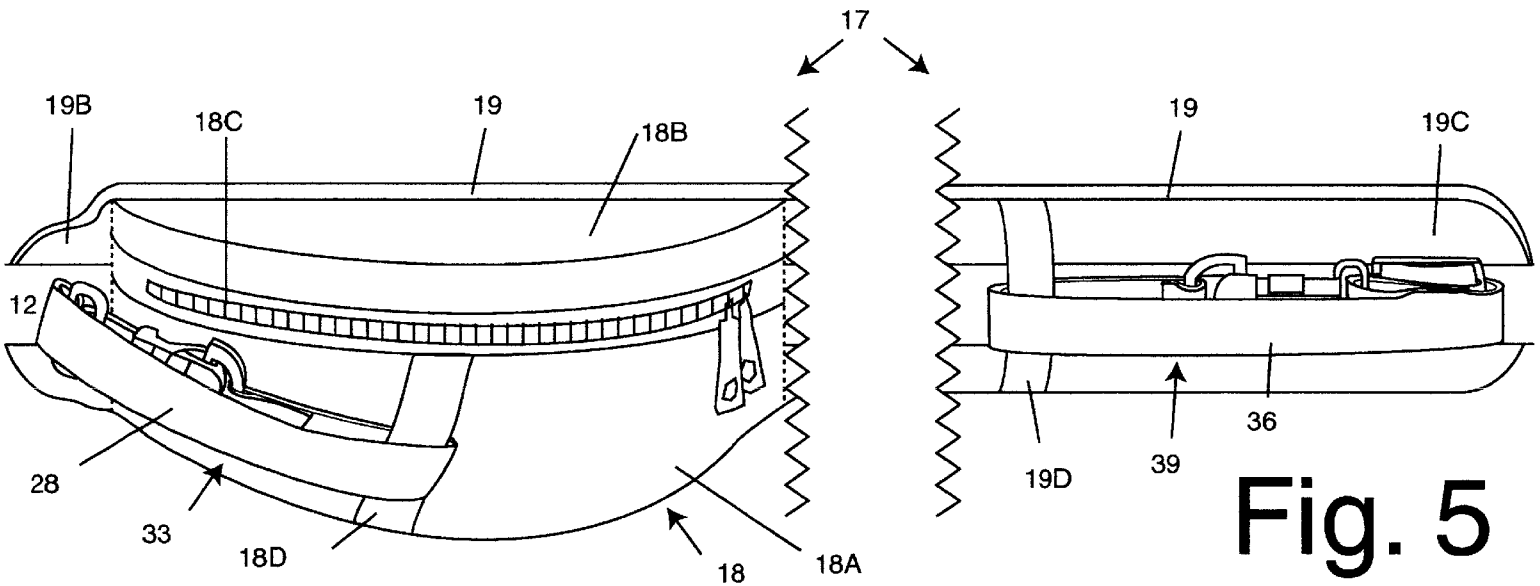
FIG. 5 is a front cut out view of the two ends of the modified shoulder pad mounted on the belt.

Referring to FIG. 5, the storage bag 18 component of the modified shoulder pad 17 resembles those storage bags mounted on article carriers, which are commonly known as fanny packs and incorporate features of known design. These incorporated features include a body portion 18A, a lid portion 18B, and an articulating means such as a zipper 18C. Mounted on the body portion 18A on the storage bag 18, and near the stabilization end 19B, an anchor strap 18D is secured at each end thereof, by stitching points or other such means. Anchor strap 18D, is positioned such, that it is perpendicular to the length of the belt 12 and hence the length dimension of the modified shoulder pad 17.

Figure 6:
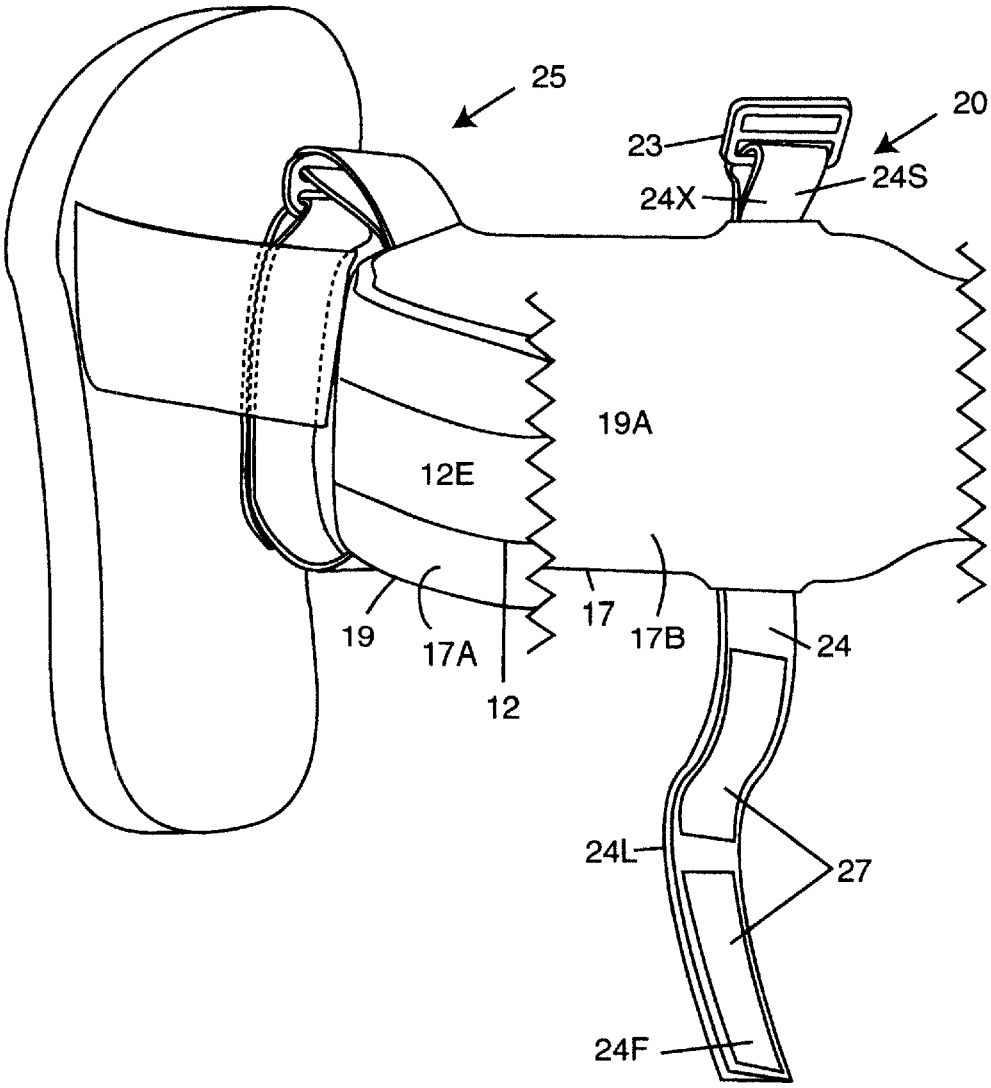
FIG. 6 is an operational and an angled perspective view of the secondary equipment securing mechanism mounted on a portion of the shoulder pad.

Referring to FIGS. 6 and 9A, another element, which can impart extra functionality to the accessory, is the secondary equipment securing mechanism 20. The secondary equipment securing mechanism 20 is particularly useful for those users requiring a pair of walking shoes, a helmet, or other additional equipment. Walking shoes are somewhat bulky and dirty, making it difficult to accommodate them in the storage bag portion 18 of the modified shoulder pad 17. As one mechanism is capable of securing one shoe, there are at least two such mechanisms needed to carry a pair of walking shoes. The secondary equipment securing mechanism 20 can either be fixed directly to the belt 12, or the mechanism can be fixed to the accessory 10 in combination with the modified shoulder pad 17. In these illustrations, the secondary equipment securing mechanism 20 illustrated here is shown here together with the modified shoulder pad 17. The secondary equipment securing mechanism 20 is attached to the modified shoulder pad 17 at the widened area 19A of the shoulder pad 19.

Referring to FIG. 6, the secondary equipment securing mechanism 20 is composed of a double slotted slider buckle 23 and a flexible strap 24 and a set of complimentary fastening material 27. The flexible strap 24 has a fixed end 24X, attached to one of the two slots integral to the slider buckle 23, and a free end 24F left unattached. The flexible strap 24, like all the straps in the present invention, is two-sided. The self-complimentary fastening material 27 is attached on one of its two surfaces. Preferably, the fastening material 27 takes the form of complementary hook and loop fastening materials. The fastening material 27 is arranged and spaced such that it comes into contact when the flexible strap is folded back on itself. Thus, the flexible straps 24 can be folded back on itself and releasably secured to itself by the overlap of the fastening material 27. The secondary equipment securing mechanism 20 is attached and perpendicular to the widened area 19A on the modified shoulder pad 1.7. Stitching, riveting and/or other suitable methods secure this attachment. The flexible strap 24 is asymmetrically attached to the modified shoulder pad 17 at a point substantially nearer its fixed end 24X. Hence, the flexible strap 24 is divided into a short arm 24S and a long arm 24L as it intersects the modified shoulder pad 17. The fixed end 24X with the attached slider buckle 23 is contained in the shorter arm 24S. Correspondingly, the free end 24F with the closely attached complimentary fastening material 27 is contained in the longer arm 24L and extends in the opposite direction from the shorter arm 24S. Preferably, the shorter arm 24S being attached to the slider buckle 23 and the storage bag lid 18B are on the same lateral side of the modified shoulder pad 17. A closed loop 25 results when the longer arm is threaded through the available slot in the slider buckle 23 and then folded back on itself, thereby allowing the complimentary fastening material 27 to releasably secure the flexible strap 24 to itself. The closed loop 25 forms on the external surface 12E of the belt 12 and the front side 17A of the modified shoulder pad 17. And, referring to FIG. 9A, as the flexible straps are positioned perpendicularly to the belt 12, so is the resulting closed loop 25.

OPERATION

FIGS. 1–9

FIGS. 1,4,7,8,and 9, refer to the dual use accessory 10 designed to interchange between two alternative conformations. Each conformation provides a different and independent function of the accessory 10. In the contracted conformation, the accessory 10 acts as a waist belt. This waist belt is completely portable and eliminates the need to find a storage facility to stow the present invention when it is not being used as a sling in the extended conformation. In the extended conformation, the accessory 10 acts as a sling to carry various pieces of equipment and can be adjusted to fit a variety of users. Furthermore, there are two different configurations the sling can adopt while in the extended conformation. These configurations are optimized for carrying objects of either a modular nature or an elongated nature and are designated as configuration A and B, respectively.

Referring to FIGS. 6 and 9A, extra functionality and features are imparted to the accessory when a modified shoulder pad 17 and/or a secondary equipment securing mechanism 20 is attached to the accessory 10. These elements can be deployed on the accessory 10 either separately, or in tandem with both elements added together, as is shown here. The modified shoulder pad 17 provides both a storage bag 18 and a supportive shoulder pad 19. The storage bag 18 can be accessed when the accessory 10 is used as a belt in the contracted conformation or as a sling in the extended conformation. The shoulder pad 19 will cushion the user from the carded weight load placed on the user, shoulder when the accessory is used as a sling in the extended conformation. The secondary equipment securing mechanism 20 can secure equipment ranging from footwear to hats. In effect, the secondary equipment securing means 20 provide an alternative storage option to the storage bag 18 associated with the modified shoulder pad 17.

Figure 4:
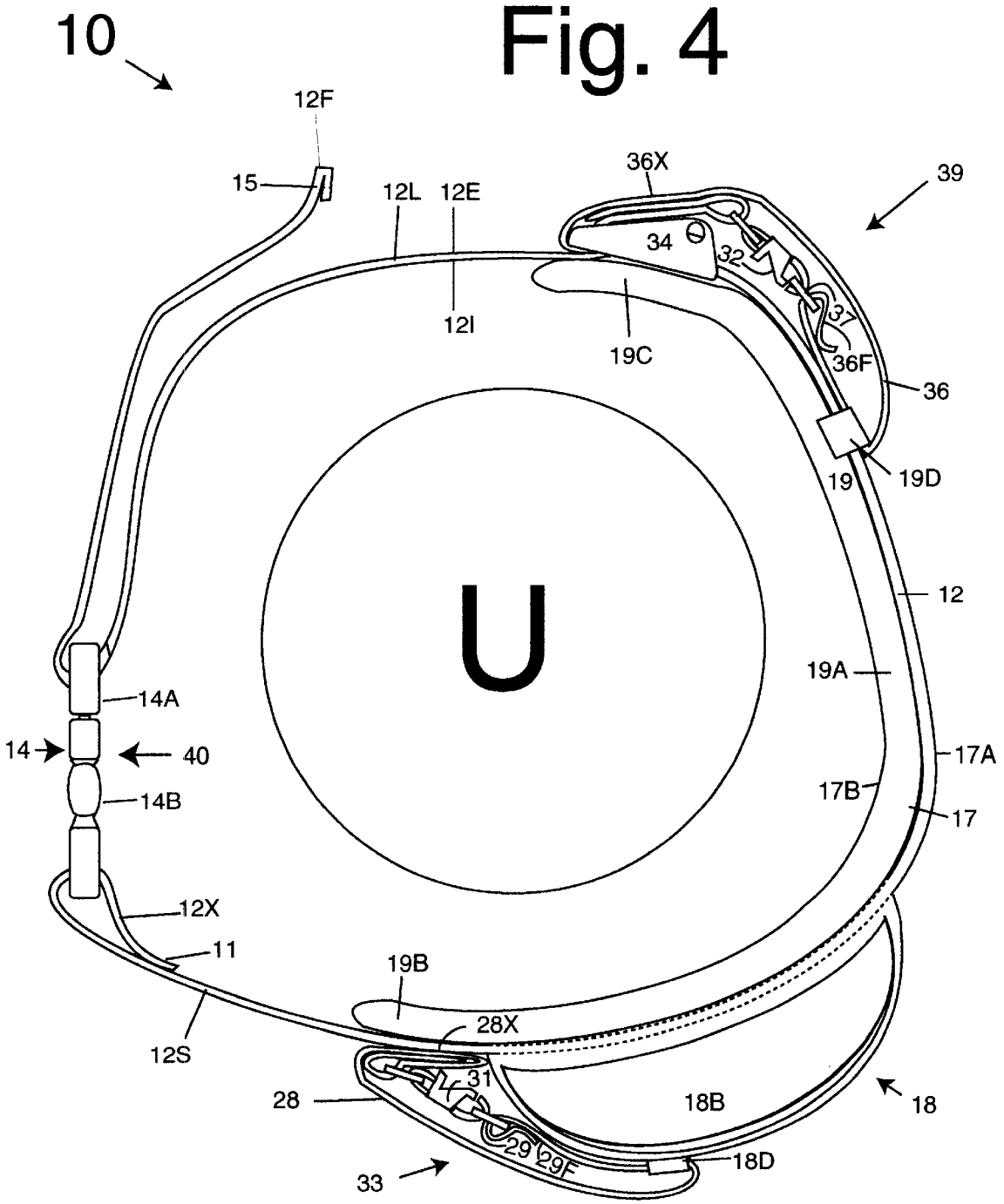
FIG. 4 is a top perspective view of the accessory with an attached modified shoulder pad.

Referring to FIGS. 1A and 4 the elongated belt 12 of accessory 10 is adjustable in length. Interior surface 12I is the surface that will be facing the user (U) when the accessory is worn either as a sling or belt. Exterior surface 12E is the surface that will face away from the user (U) when the accessory is worn either as a sling or belt. The belt can be releasably secured through the use of releasable securing connectors 14.

The releasable securing connectors consist of male and female connectors 14A and 14B, respectively. The female connector 14B is secured to the fixed end 12X of belt 12 by sewn bend 11 in the flexible material composing the belt 12. The male connector 14A is slidably secured on the long section 12L of the belt 12. The free end 12F of the belt 12 is threaded through the integrally associated ladderlock portion of the male connector 14A. In this scheme, the male connector 14A is allowed to move along the unobstructed length of belt 12. Sewn bend 15 prevents the male connector 14A from sliding off the belt 12. Alternatively, referring to FIG. 9B, the female connector 14B can also be mounted on the belt 12 in the same adjustable fashion as the male 14A by including a ladderlock portion in the body of the female connector 14B. The articulation between the releasable securing connectors 14 provides the enclosed belt 40 that can be adjusted in size. The diameter of the enclosed belt 40 can be adjusted by varying the position of the male connector member 14A along the available length of the belt 12. As the male connector 14A is positioned toward the fixed end 12X, the enclosed belt 40 becomes smaller in diameter. The enclosed belt 40 is used as a sizable waist belt in the contracted conformation. This waist belt is completely portable and hence eliminates the need for the user to find a secure area to stow the accessory 10 when it is not being used as a sling. Alternatively, referring to FIG. 7, in the extended conformation the accessory 10 acts as a sling. The enclosed belt 40 secures the enclosed belt 40 around the user's torso and stabilizes the carded load on the user's load bearing shoulder.

Referring to FIGS. 1A and 4, the load-bearing straps 28 and 36 are attached to the belt 12. The load-bearing straps 28 and 36 are used to secure and carry loads when the accessory 10 is used as a sling. Both ends of the load-bearing straps 28 and 36 are attached to complementary connectors. Preferably these take the form of a pair of complementary buckles commonly known as a snapper buckle and a D-ring or similar enclosing device. In such manner, both the snapper-like buckles 31 and 32 can be either be connected or disconnected to the D-ring 29 and 37, respectively.

Load-bearing straps 28 and 36 are arranged such that the fixed ends 28X and 36X are attached to the belt 12 of the accessory 10. The opposite free ends 28F and 36F are not secured to the accessory and thus have a high degree of mobility relative to the fixed ends 28X and 36X. Hence, the free ends 28F and 36F bearing the D-rings 29 and 37, can be folded back along the length of the respective load-bearing straps 28 and 36, and connected with the snapper-like buckle 31 and 32 secured at the fixed ends 28X and 36X respectively. The load-bearing straps 28 and 36 arranged in this manner form the cargo-carrying loops 33 and 39. Cargo-carrying loops 33 and 39 are used to support or secure selected equipment when the accessory is used as a sling in the extended conformation. The main difference between load-bearing strap 28 and 36 lies in the fact that load-bearing strap 36 is movable along the length of the long portion 12L of belt 12. Load-bearing strap 28 is attached directly to the belt 12, whereas, loadbearing strap 36 is slidably attached to long portion 12L of belt 12 via a position lockable slider device known as a modified cam buckle 34. Hence, the cargo-carrying loop 39 can be adjusted along the available length of the long portion 12L of belt 12. The accessory 10 acting as a sling is sizeable with cargo-carrying loop 33 fixed and the other cargo-carrying loop 39 adjustable. This adjustable nature allows the accessory 10 to fit a variety of users.

Referring to FIGS. 2A, 2B, and 3, the modified cam buckle 34 contains two slots located on its bottom side. The belt 12 runs through the body of the modified cam buckle 34 and is diverted out the bottom through a first slot 34A. This arrangement allows the belt to reversibly slide through the modified cam buckle 34. Thus the modified cam buckle 34 can be moved along the unobstructed length of the long portion 12L of belt 12. The modified cam buckle 34 can also be clamped down and rendered immobile along any available section of the long portion 12L of belt 12. Hence, modified cam buckle 34 allows the user to move or reposition load-bearing strap 36 anywhere along the available length of long portion 12L of belt 12.

Figure 7A:
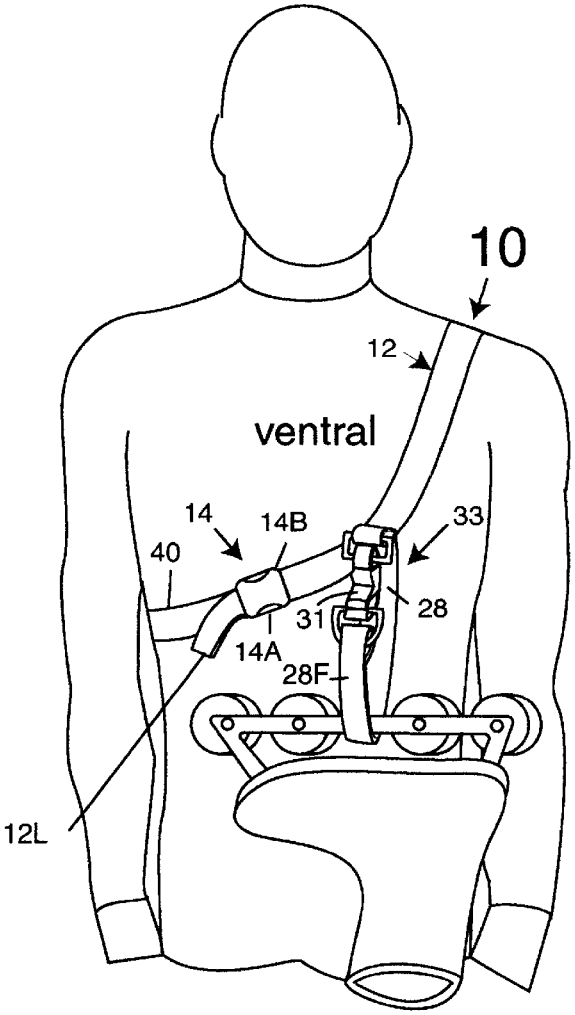
FIG. 7 is an operational view of the accessory acting as a sling in the extended conformation and in configuration A.
Figure 7B:
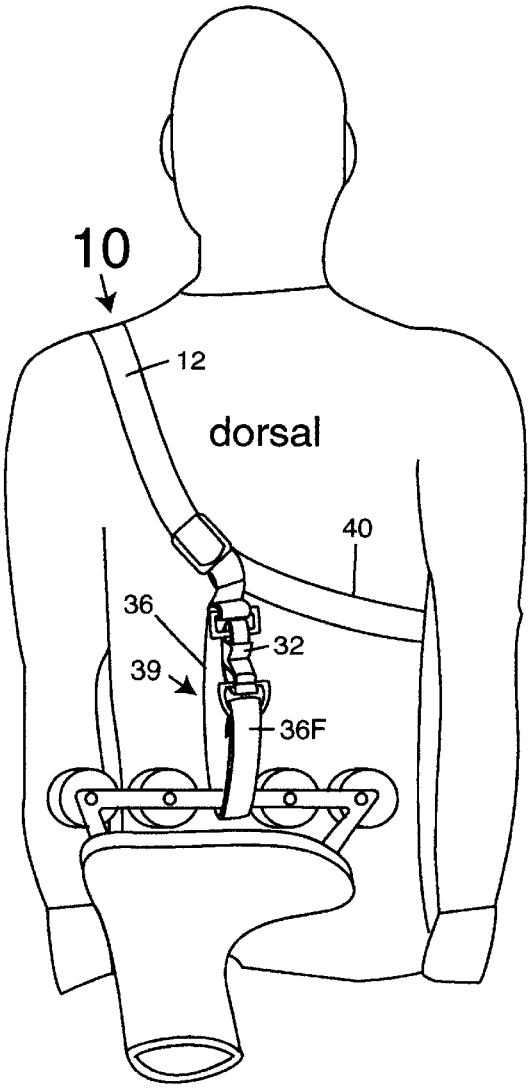

Referring to FIGS. 7A and 7B, cargo-carrying loops 33 and 39 secure carded equipment by either linking to an aperture integral to the equipment or wrapping around a portion thereof. For instance, in many in-line skates there is a hole, enclosed area, or aperture between the multi-wheeled chassis and skate boot; on snowboards there are apertures available on the binding that can articulate with the free ends 28F and 36F of load-boearing strap 28 and 36. The free ends 28F and 36F of load-bearing straps 28 and 36 can be threaded through such available apertures and connected back to the snapper buckles 31 and 32 forming the cargo-carrying loops 33 and 39, respectively. Hence the cargo-carrying loops 33 and 39 are capable of releasably securing carded equipment.

Alternatively, forming the cargo-carrying loops 33 and 39 around a protrusion integral to the equipment can carry equipment lacking such integral apertures. For instance, skateboards have protruding wheel assemblies know as trucks. The skateboard can be secured to the accessory 10 by forming the cargo-carrying loops 33 and 39 around the trucks.

Referring again to FIGS. 7A and 7B, the accessory 10 in the extended conformation is utilized as a sling. The sling is shown in configuration A and is configured to carry components of a modular nature. The sling operates by using one of the user's shoulders as a load bearing shoulder. The belt 12 of the accessory 10 is positioned over the load bearing shoulder of the user, and the attached load-bearing straps 28 and 36 are positioned on opposite ventral and dorsal sides of the user. The load bearing shoulder acts as a fulcrum to balance carded equipment attached to the cargo-carrying loops 33 and 39. In this arrangement, a pair of modular equipment such as inline skates can be attached to the cargo-carrying loops 33 and 39 on each side of the user. The carded equipment piece attached to cargo-carrying loop 33 is fixed at a point along the belt 12. The carded equipment piece attached to cargo-carrying loop 39 can be adjustably positioned such that it acts to balances the weight load secured to cargo-carrying loop 33. The complementary members comprising the releasable securing connectors 14 can be connected under the user's second shoulder, an opposite free shoulder. This connection forms the enclosed belt 40. In configuration A, enclosed belt 40 acts as a stabilization strap and firmly secures the sling to the user's body. The enclosed belt 40 essentially connects the two cargo-carrying loops 33 and 39 of the sling together. The enclosed belt 40 serves to restrict how far apart from each other the carded equipment can dangle or stray. This arrangement minimizes the possibility that the carded items will swing out and knock back into the user or fall off the shoulder completely. The enclosed belt 40 also pulls both the ventral and dorsal carded items more toward the mid-line area of the user's body. This arrangement allows the user to negotiate more narrow thoroughfares. Furthermore, the enclosed belt 40 acting as a stabilization strap can be tightened or loosened by adjusting the length of the long portion 12L of belt 12 that is extending through the integrally associated ladderlock portion of the male connector 14A. This adjustment is yet another feature of the accessory 10, which allows the user to customize the accessory 10 to his or her specifications.

Figures 8A, 8B, 8C:
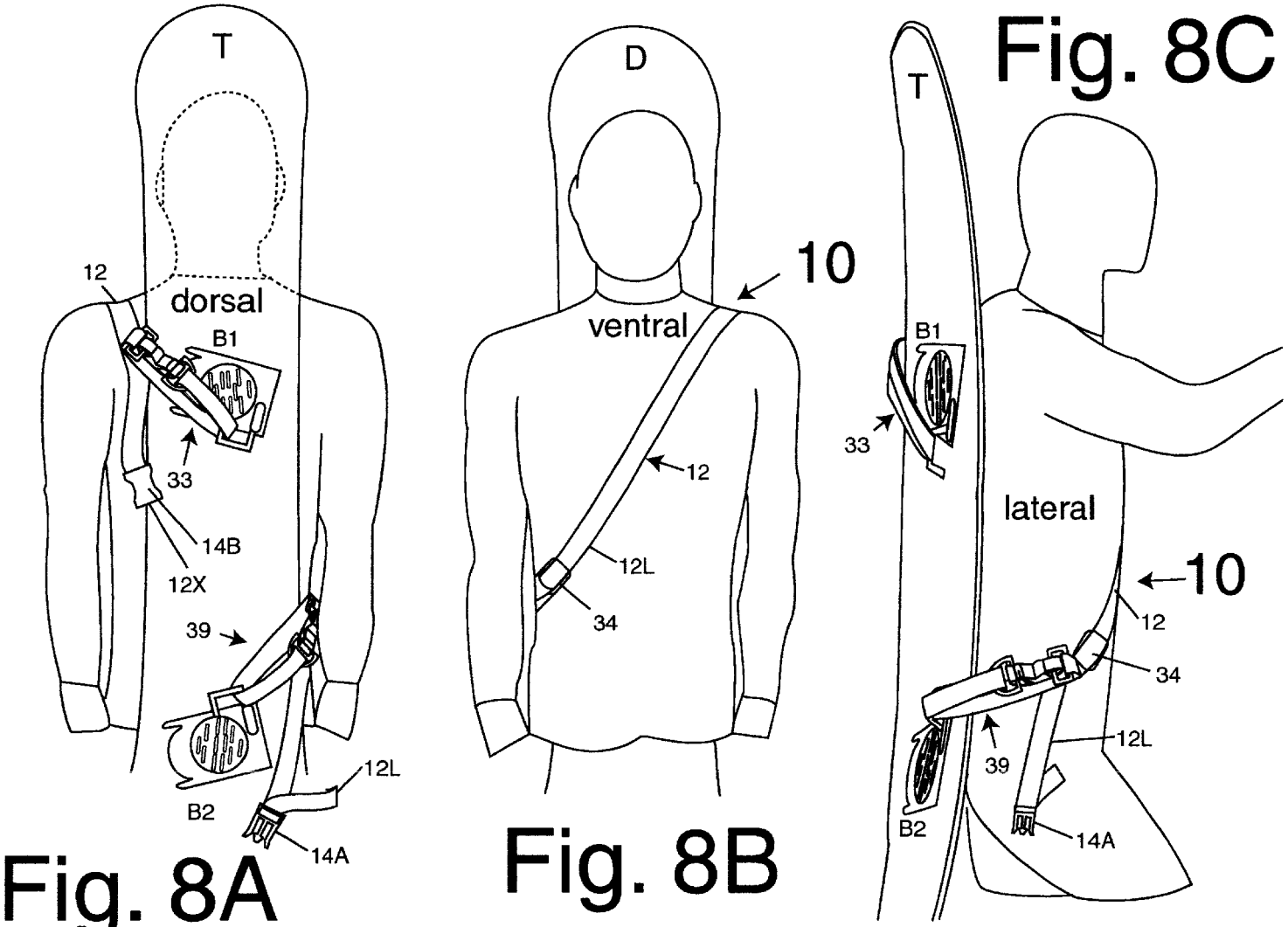
FIG. 8 is an operational view of the accessory acting as a sling in the extended conformation and in configuration B.

Referring to FIGS. 8A, 8B, and 8C, the accessory 10 in the extended conformation is utilized as a sling. The sling is shown in configuration B and is configured to carry components of an elongated nature such as a snowboard and hold it in an upright position against the user's dorsal side. In this configuration, the accessory 10 is attached to a first and second binding points B1 and B2 integrally associated with the snowboard. Both binding points B1 and B2 are located on the top surface T of the snowboard. The snowboard is positioned such that the bottom-side D is positioned against the user's dorsal side. The accessory 10 acting as a sling operates by using one of the user's shoulders as a load bearing shoulder. The belt 12 of the accessory 10 is positioned over this load bearing shoulder and extends across the ventral side of the user's torso in an angled fashion. The load bearing shoulder acts as a fulcrum from which hangs the carded equipment on the dorsal side of the user. Just off this load bearing shoulder, on the dorsal side of the user and attached near the fixed end 12X of belt 12, the cargo-carrying loop 33 is secured to binding point B1. Cargo-carrying loop 33 secures the snowboard such that the snowboard hangs off the load bearing shoulder. The attached long portion 12L of the belt 12 is positioned over the user's load bearing shoulder and continues in a downward direction, angling across the ventral side of the user, and winding back around to the user's dorsal side under the user's opposite free shoulder. The accessory 10 is then reconnected to the topside T of the snowboard at binding point B2. Cargo-carrying loop 39 is positioned via the modified cam buckle 34 such that it attaches the accessory 10 to the snowboard at the second binding point B2.

Referring to FIG. 8 and especially 8C, the snowboard hung on the user's dorsal side is balanced by the tension created in the belt 12 on the ventral side of the user. This tension is created by the adjustment of the modified cam buckle 34. As noted above, the modified cam buckle 34 positions the cargo-carrying loop 39 near the second binding point B2 of the snowboard. In this position the cargo-carrying loop 39 pulls the bottom surface D of the snowboard toward the dorsal side of the user. Accordingly, the correct positioning of the modified cam buckle 34 tightens the accessory 10 and hence the sling around the user (U). Referring to FIG. 8A, the long portion 12L of belt 12 positioned in an angled crossing arrangement along the ventral side of the user's torso, is under tension or becomes taught when the cam buckle 34 is positioned to remove any slack between the cargo-carrying loop 39 and the belt 12. This tension serves to balance the snowboard, which is attached to cargo-carrying loop 33 and hung from the user's load bearing shoulder on his or her dorsal side.

Furthermore, referring to FIG. B, the cargo-carrying loops 33 and 39 attach to their respective binding points B1 and B2 from opposite direction s and lateral sides of the snowboard. The arrangement of securing the snowboard from two opposite lateral sides, not only serves to secure the snowboard to the user's back but also to hold it in a upright position parallel with the user's dorsal side.

Referring again to FIGS. 9A and 9B, a modified shoulder pad 17, consisting of a storage bag 18 attached to a shoulder pad 19, can be attached to the accessory 10. The addition of the modified shoulder pad 17 provides extra functionality to the accessory 10. The shoulder pad 19 provides a pad to ease the burden of weight when the accessory is being used as a sling. Both the stabilization end 19B and the free end 19C, of the shoulder pad 19 prevent rolling or twisting of the belt 12 when the accessory is worn as a waist belt. Furthermore, in the contracted conformation, the widened area 19A on the shoulder pad 19 is positioned at the small of the user's back and prevents the belt 12 from rotating or otherwise revolving around the user's waist. The storage bag 18 makes up the other component of the modified shoulder pad 17. The zipper 18C articulates the body portion 18A with the lid portion 18B of the storage bag 18. Generally, contemporary exercise clothing do es not incorporate many pockets on t he garment in which important items can be stowed. The storage bag 18 can be used to securely stow personal items such as wallets, keys, and personal stereos. The storage bag 18 can be accessed when the accessory 10 is used as either a waist belt in the contracted conformation or a sling in the extended conformation.

Referring to FIGS. 4 and 5, the accessory 10 in the contracted conformation, is utilized as a waist belt and is fully portable. In this conformation, the cargo-carrying loops 33 and 39 must be secured against the belt 12. The modified shoulder pad 17 contains cargo-carrying loop securing means in the form of anchor straps. The anchor straps 18D and 19D are attached to the front side of modified shoulder pad 17 and act as lashings on which to attach and secure the cargo-carrying loops 33 and 39 respectively. The modified shoulder pad 17 is mounted on the belt 12 between the closed cargo-carrying loops 33 and 39, created by the load-bearing straps 28 and 36. Hence the cargo-carrying loops 33 and 39 on opposite sides of the modified shoulder pad 17 can be secured along the modified shoulder pad 17 in a direction towards one another. The cargo-carrying loops 33 and 39 ar e secured to the anchor straps 18D and 19D in a similar manner as they are used to carry equipment in the extended conformation. In this arrangement, the load-bearing strap composing the cargo-carrying loop is first threaded through the anchor strap and then connected back to the attached snapper-like buckle, thus forming the cargo-carrying loop around the anchor strap. Alternatively, the accessory 10 without the benefit of the modified shoulder pad 17 could have the cargo-carrying loops 33 and 39 secured by attaching the cargo-carrying loops 33 and 39 to each other and positioning the modified cam buckle 34 such that there is no slack in the belt 12 between the cargo-carrying loops 33 and 39.

Referring to FIG. 6, As mentioned earlier, the secondary equipment securing mechanism 20 can be employed to secure additional equipment such as walking shoes and baseball caps. The secondary equipment securing means 20 is shown here in conjunction with the modified shoulder pad 17. The secondary equipment securing mechanism 20 operates by either encircling a carded equipment piece, or by threading the long arm 24L of the flexible strap 24 through any available aperture integral to the carded object. For instance, walking footwear, such as open-toed sandals, often have a piece of material which traverses the sole portion of the sandal. The long arm 24L of flexible strap 24 can be thread between the traversing material and the sole of the sandal. The long arm then continues through the available slot in the slider buckle 23 and then folds back on itself. This folded back arrangement forces the flexible strap to overlap with itself in between the traversing material and the sole of the sandal. This overlap brings the complimentary fastening material 27 into contact and consequently forms the closed loop 25. The closed loop 25 secures the traversing material of the sandal against the front side 17A of the modified shoulder pad 17. As the user removes any excess slack between the flexible strap 24 and the slider buckle 23, the self overlap of the flexible strap 24 on itself becomes greater and the tighter the sandal will be held against the modified shoulder pad 17. The self overlap of the flexible strap 24 occurs between the traversing material and the sole of the sandal. Similarly, shoes with laces can be attached to the accessory 10 in a similar manner. In this case, the laces tied up act as the traversing material integral to sandals. Additionally, this method of securing walking footwear can also be applied to available apertures in such equipment as baseball caps and helmets.

Alternatively, the secondary equipment securing mechanism 20 can articulate with carded objects by synching down around the object. In this case, the closed loop 25 forms around an object or portion thereof. Once again as the user removes any slack between the flexible strap 24 and the slider buckle 23, the self overlap of the flexible strap 24 becomes greater and the secondary equipment securing mechanism 20 will synch down tighter around the carded object. One could envision, a blanket, or even a pair of shoes stacked upon one another, being carded in this fashion.

Referring to FIGS. 9A and B, as noted earlier, the modified shoulder pad 17 is defined by two principally different components; the storage bag 18 and the shoulder pad 19 can be mounted on the accessory 10 in two different arrangements. These two different arrangements optimize the accessory towards one of two particular configurations A and B that are available when the accessory 10 is utilized as a sling in the extended conformation. The optimization of the accessory 10 towards configuration A or B resulting from the addition of the modified shoulder pad 17 is due to the alternate placement of the storage bag 18 along the long portion 12L of belt 12. Referring to FIG. 9A, configuration A is optimized when the modified shoulder pad 17 is mounted the on the belt 12 such that the storage bag 18 immediately borders the load-bearing strap 28, and the adjacent stabilization end 19B extends into the short portion 12S of belt 12. Referring to FIG. 9B, configuration B is optimized when modified shoulder pad 17 is mounted with the opposite free end 19D extending into the short portion 12S of the belt 12 and storage bag 18 is oppositely positioned nearer the mid point of the belt 12. The stabilization end 19B, also serves to protect the user from the tension created in the long portion 12L of the belt 12 as the belt 12 moves around to the user's dorsal side.

Referring again to FIG. 4, regardless of how the modified shoulder pad 17 is mounted on the accessory 10, both the stabilization end 19B and the free end 19C can be used as a potential surface on which the modified cam buckle 34 can be secured upon when the accessory 10 acts as a waist belt in the contracted conformation. This placement protects the user from any irritation that could result from the modified cam buckle 34 being positioned directly against the user. As noted above, both arrangements of the modified shoulder pad 17 on the accessory 10 are operational for both configurations A and B of the accessory 10 in the extended conformation. The specification is possible due to the continuous nature of the underlying shoulder pad 19. The shoulder pad 19 generally has the same shape and placement on the accessory 10 whether the modified shoulder pad 19 is mounted to optimize either configurations A or B. The main difference between the two configurations is the positions of the storage bag 18.

Referring to FIG. 9B, the accessory 10 is shown with the modified shoulder pad 17 mounted to compliment configuration B. The snapper-like buckles 31 and 32 take the form of carabiners. Carabiners are snapper-like buckles, which are easy to open and manipulate. Hence, carabiners may be more amenable to winter sports users whom employ large and bulky gloves, which limit the dexterity of the user. In this arrangement the D-rings 37 are substituted by the integral loops created at the free ends 28F and 36F by the sewn bends 28B and 36C. A piece of rubber or other suitably stiffer material sewn to the inside surface of each loop will further reinforce the integral loops replacing the D-rings 29 and 37.

Figure 9C:
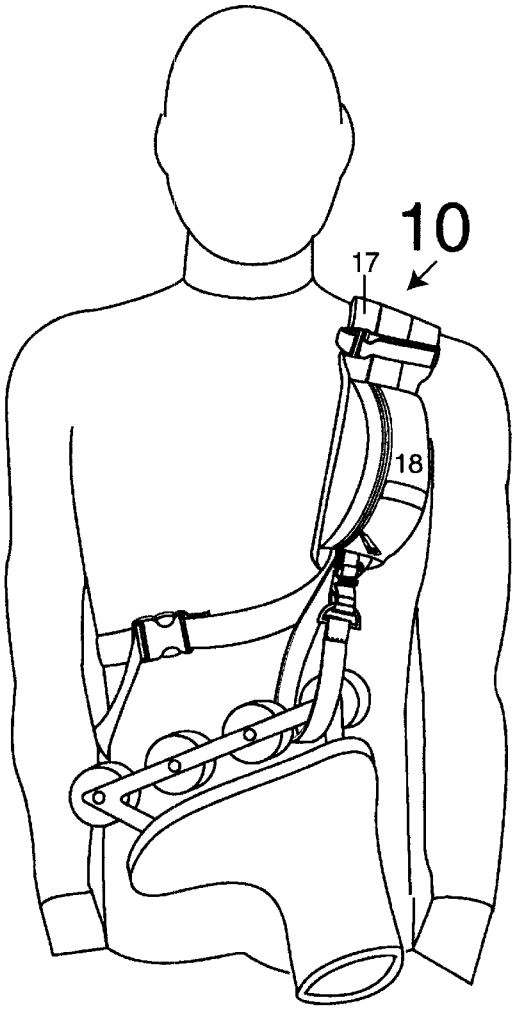
FIG. 9C is an operational view of the accessory mounted with the modified shoulder pad and in configuration A.
Figure 9D:
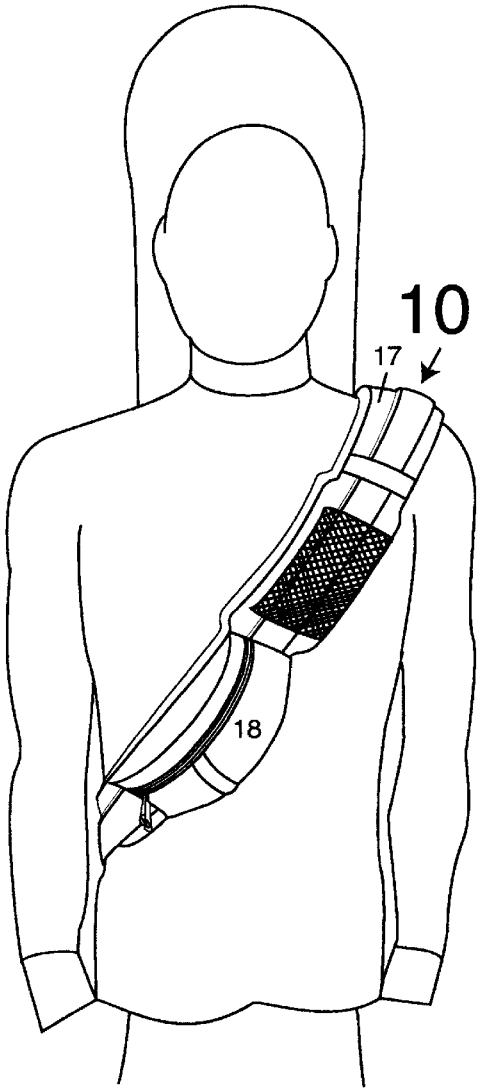
FIG. 9D is an operational view of the accessory mounted with the modified shoulder pad and in configuration B.

Referring to FIG. 9C, The accessory 10 is shown in the extended conformation and in configuration A. The addition of the modified shoulder pad 17 such that it optimizes configuration A results in the storage bag 18 being accessible to the user at the user's chest. Likewise, referring to FIG. 9D, the accessory 10 is shown in the extended conformation and in configuration B. The addition of the modified shoulder pad 17 such that it optimizes configuration B results in the storage bag 18 being accessible to the user near the user's stomach.

CONCLUSIONS, RAMIFICATIONS, AND SCOPE

Accordingly, the reader will see that the interchangeable equipment carrier/waist belt, otherwise referred to as the accessory; is an interchangeable device with two independent functions. This feature effectively grants a dual use purpose to the accessory. The frame of the accessory is composed of a belt with attached closure means. Attached to the belt are two cargo-carrying loops used to secure carded equipment to the accessory and hence user. At least one of these loops is secured to the belt via a position lockable slider, such as the described modified cam buckle.

The accessory can interchange between two conformations; an extended conformation, and a contracted conformation. In the extended conformation, the accessory acts as a sling. This sling is used to carry and hold heavy and/or awkward equipment of either a modular nature such as skates, ski boots, and grocery bags or an elongated nature such as snowboards and skateboards. These heavy and awkward sized pieces of equipment are often difficult to accommodate in many modern article carriers (such as backpacks). The accessory enables the user to transport an awkward sized object(s) by positioning the object(s) such that it is carried in a sling fashion, where the weight is balanced on the user's shoulder. In the contracted conformation, the accessory acts as a waist belt. This waist belt is completely portable and can accompany the user as he or she moves to different physical locations. Thus the user does not have to find a place to stow the accessory when it is not used as a sling in the extended conformation. Many of the possible equipment loads such as skates and snowboards need to be transported to various sites for use; the easy and convenient portable nature of the accessory becomes advantageous to the mobile user.

As noted earlier, the accessory can act as a sling in the extended conformation. Slings in general can be described as having two sling arms extending in directions away from a fulcrum. The sling uses the fulcrum to balance the weight placed on each opposing arm. In much the same way, the accessory acting as a sling utilizes the user's load bearing shoulder as a fulcrum and extends sling arms out from opposite sides of the shoulder. Hence a sling arm could be likened to the distance on the belt of the accessory between the cargo-carrying loop (where the accessory articulates with carded components) and the point at which the belt articulates with the user's shoulder (which denotes the position of the fulcrum). There are two different configurations the accessory can adapt to while acting as a sling in the extended conformation. The main difference in these sling configurations is where the user places his or her load bearing shoulder and hence the fulcrum. For the sake of simplicity, these configurations are denoted A and B.

Configuration A is arranged to hang a pair of modular components such as inline skates, off the user's load bearing shoulder, on the dorsal and ventral sides of the user. The attached cargo-carrying loops are positioned on both the dorsal and ventral side of the user. This arrangement utilizes the user's load bearing shoulder as a fulcrum with sling arms extending out on both the dorsal and ventral sides of the user. These sling arms secure modular component on each of the ventral and dorsal side of the user. At least one of the attached cargo-carrying loops is attached to the belt via a position lockable sliding means such as a modified cam buckle. The modified cam buckle can vary the position of the attached cargo-carrying loop along the belt of the accessory and thus change the distance between the cargo-carrying loops. In this manner, the length of the sling arms can be altered to fit a variety of different users as well as balance a variety of different components. In addition, the accessory used in this configuration is stabilized on the user's shoulder by the formation of the enclosed belt, which connects both the ventral and dorsal arms of the sling. This enclosed belt secures the sling arms to one another by connecting the sling arms under the user's free shoulder opposite to the load bearing shoulder.

Furthermore, the sling can be used in this configuration to carry a single modular item like a suitcase or grocery bag. In this scenario, both cargo-carrying loops meet beneath the load bearing shoulder bearing the belt of the accessory. Both of the cargo-carrying loops attach to the modular piece of equipment through an integral aperture such as a handle. The single modular item is carded along the user's side in a purse-like fashion.

Similarly, elongated items such as a pole of sorts can be threaded through both the cargo-carrying loops. The user then carries the elongated items as if he or she was carrying a singular modular component- over the shoulder in a purse fashion. The elongated piece of equipment being threaded through both cargo-carrying loops is carried at the side of the user. Elongated equipment carried in this fashion, lie perpendicular to the height of the user at the user's side.

Configuration B is arranged to hang elongated components such as a snowboard off the user's shoulder along his or her dorsal side. The attached cargo carrying loops are both positioned on the dorsal side of the user. As in configuration A, configuration B utilizes the user's load bearing shoulder as a fulcrum with sling arms extending out on both the dorsal and ventral sides of the user. However, unlike configuration A, the two arm lengths of the sling are vastly unequal. The accessory acting as a sling in configurations B is arranged such that one arm length of the sling is substantially shorter relative to the other. The cargo-carrying loop which define the border between the long and short sections of the belt, and defines the end of the shorter sling arm is positioned just off the user's load bearing shoulder on the user's dorsal side. This cargo loop attaches the accessory to the snowboard and in effect hangs the snowboard from the user's load bearing shoulder. The other longer arm is positioned over the user's load bearing shoulder, and slanted downward across the ventral side of the user's torso and wound around the user's opposite side, under the user's opposite free shoulder and then connects back to the carded snowboard on the user's dorsal side. The slidably opposed cargo-carrying loop is adjusted such that it defines the end of the longer sling arm and attaches to the snowboard carried on the user's dorsal side. This arrangement of the long arm running around the ventral side of the user and secured back to the carded snowboard on the dorsal side of the user creates tension in the belt of the accessory. This tension balances the snowboard secured by the cargo-carrying loop on the shorter sling arm of the accessory. The tension is created and controlled through the position lockable sliding means. The tension is increased by removing any slack in the belt between the cargo-carrying loops attached to the snowboard. As the tension is increased, the bottom surface of the snowboard is pulled against the user's dorsal side and the accessory acting as a sling is drawn tighter around the user. This configuration positions the snowboard or similar elongated cargo load along the user's dorsal side in a generally upright position and forces the cargo-carrying loops to articulate with the cargo load from both opposite sides and directions. This arrangement provides the proper tension to keep the snowboard upright along the user's back.

Skateboards are carded in similar manner as snowboards. The cargo-carrying loops can be used to articulate with the protrusion forming the wheel assemblies known as trucks on a skateboard. The trucks serve a similar role as the binding points on the snowboard and similarly, the cargo-carrying loops articulate with the trucks by forming around each truck. The accessory adapted to configuration B and attached to the bottom side of the skateboard at the trucks, positions the top surface of the skateboard against the user's dorsal side. In this fashion the skateboard is carried in an upright manner along the user's dorsal side in a similar fashion as the snowboard.

Another possible use of the accessory adapted to configuration B is to carry snow skis in an upright manner along the user's back. For the skis to be carded in a similar manner as the snowboard, the skis would have to be connected to each other in a side by side manner. For instance, a pair of molded clamps could be used to bind the skis in a side-by-side manner. These clamps could be employed at both the shovel and the tail end of the skis. This arrangement will provide the skis with a greater effective surface area on the bottom side of the skis. As in the case of the snowboard, the bottom-side of the skis are positioned against the dorsal side of the user. However, unlike the snowboard case, the cargo-carrying loops articulate with the protrusions that compose the ski bindings. The cargo-carrying loops can encircle or lasso the protrusion and thus secure the skis without the use of an available aperture integrally associated with the carded equipment.

Additionally, the accessory adapted in configuration B can be alternately arranged on the user. This alternate arrangement of the accessory adapted in the B configuration differs from the arrangement described above in several aspects. First, rather than the accessory utilizing a shoulder of the user as a fulcrum, the accessory utilizes the user's neck as a fulcrum. Second, rather than the fulcrum being positioned substantially towards one end of the belt resulting in sling arms of unequal lengths oppositely extending out on the dorsal and ventral sides of the user's, the fulcrum is positioned substantially near the midpoint of the belt resulting in sling arms of roughly equal length extending in a parallel manner out on the user's ventral side. As the cargo-carrying loops are disposed substantially towards opposite ends of the belt when the accessory is adapted in configuration B, this alternate arrangement of the accessory on the user positions the cargo-carrying loops on the ventral side of the user. In this manner the accessory is worn in a necklace like fashion and can bind and balance cargo loads on the ventral side of the user.

The addition of a modified shoulder pad, consisting of a storage bag attached to a shoulder pad, will provide extra functionality to the accessory. The modified shoulder pad provides a shoulder pad, which serves to cushion and support the user's shoulder when the accessory acts like a sling in the extended conformation.

Furthermore, the shoulder pad is shaped as to center and secure the modified shoulder pad around the user's waist when the accessory acts as a waist belt in the contracted conformation. The storage bag allows the user to stow personal effects and other necessary items. This storage bag can be used and accessed in both conformations of the accessory.

The interchangeable equipment carrier sling/waist belt can also be used as a multifunctional shoulder belt on a piece of luggage or larger cargo enclosing bag. The male and female connector members on the accessory could be attached to complementary male and female members on a bag. Hence the combined large storage bag and interchangeable equipment carrier sling/waist belt would act as a multifunctional luggage system. The user could carry support cargo to a specific area such as a hotel and then could use the interchangeable equipment carrier sling/waist belt while the user is mobile moving from one location to the next as described above. Furthermore, the addition of a modified shoulder pad would provide padding to the interchangeable equipment carrier sling/waist belt acting as a shoulder strap for a piece of luggage.

Another embodiment of the modified shoulder pad would conceive of a slidably mounted modified shoulder pad being attached to the accessory. This sliding shoulder pad would be allowed to slide along the available length of the long portion of the belt in a similar manner as the position lockable slider. Since the shoulder pad can be moved to different areas of the belt, the shoulder can act as a fulcrum at different areas on the accessory when it is used as a sling in the extended conformation. Hence, this addition would optimize the accessory to both configurations A and B. Furthermore, a storage facility could be designed into the slidably attached shoulder pad. The arrangement would provide a modified storage facility with the shoulder pad attached to the back of the storage bag. Hence the belt would be sandwiched between the storage bag and the shoulder pad. This embodiment would also be consistent with the belt running along the rear side of the storage bag and along the front side of the shoulder pad as described and illustrated here in the present invention.

The secondary equipment securing mechanism provides an alternate storage facility to that provided by the modified shoulder pad. The securing mechanism can either be used on the accessory alone or in conjunction with the modified shoulder pad. The secondary equipment securing mechanism is composed of a flexible strap, a slider buckle, and self complimentary fastening material. The flexible strap is mounted perpendicularly and asymmetrically to the belt of the accessory. This placement forms the oppositely extending long and short arms of the flexible strap. The longer arm contains the self complimentary fastening material adjacently positioned on the same surface side and the shorter arm contains the slider buckle. The long arm is thread through a slot in the slider buckle and folded back on itself forcing the hook and loop material to come in contact with one another and thereby reversibly forming an open and closeable loop.

This open and closeable loop can either secure equipment by articulating with an integral aperture contained in the equipment or by surrounding and synching down and around carded equipment. For instance, an inline skater will require walking shoes when he or she is to carry the skates to another location. In addition to being dirty, a pair of walking shoes is bulky and may not fit in the storage bag typical of many modern fanny packs. The flexible straps of the secondary equipment securing mechanism secure shoes by articulating with an integral aperture associated with the shoe. The area behind the shoelaces forms such an aperture. The long arm of the flexible straps are threaded through such apertures and then threaded through the slider buckle on the short arm. The long arm is then folded back on itself, allowing the self complimentary fastening material to come in contact, hence forming a closed loop around a portion of the carded equipment. This closed loop serves to secure the carded secondary equipment. Alternatively, equipment such as a blanket or a pair of shoes stacked upon one another can be secured by a pair of secondary equipment securing mechanism by surrounding and synching down and around carded equipment. The long arm of the flexible strap is positioned around a portion of the carded equipment such that the carded equipment is between the belt and the long arm of the flexible strap. The strap then continues through the slider buckle on the short arm and then folds back on itself allowing the hook and loop material to form a closed loop around the carded equipment. The closed loop can form a tight loop around the carded object by eliminating any slack in the flexible strap.

This can be accomplished by pulling the flexible strap through the slider buckle such that the carded equipment is secured tightly against the belt of the accessory. After the slack is eliminated in this fashion the flexible strap is folded over on itself so that it can form a closed loop around the carded equipment.

Although, the description above contains many specifications, these should not be construed as limiting the scope of the invention, but as merely providing illustrations of some of the presently preferred embodiments of this invention. For example, the accessory can employ wider webbing throughout the design to increase load capabilities and to differentiate different parts of the accessory. Instead of one cargo-carrying loop being articulated with a position lockable sliding device, both cargo-carrying loops can be attached to the belt with such sliding devices. The storage pack can also differ in design and dimensions to provide extra room to stow needed articles. Defining other compartments within the bag can further modify the storage bag. For instance, a portion of the bag could be designed to hold a water bottle. Alternatively, a water bottle holding device can be incorporated in the accessory in lieu of a storage bag. A standard cam buckle positioned such that the adjustment lever is on the side of the belt facing the user can be used instead of the modified cam buckle design. Other position lockable sliding devices, such as belt buckles with an internal rolling pin, can be substituted to attain the adjustable nature of the attached cargo-carrying loop(s). The padded extension forming the shoulder pad can be formed from a number of different padding or reinforcing materials. An additional mesh pocket can be sewn to the widened area on the front side of the modified shoulder pad. The double slotted slider buckles could be substituted with a larger single slotted design.

Furthermore, since the accessory makes no attempt to enclose the article being carried, there are no specific size limitations on the article(s). The accessory relies on securing the carded object(s) by hanging or strapping the object(s) to the user.

Accordingly, the scope of the invention should be determined not by the embodiment(s) illustrated, but by the appended claims and their legal equivalents.

What is claimed is:

1. A combination equipment carrying sling/waist belt accessory, comprising an elongated belt, made of flexible material having a length defined by two opposite ends, said length containing a midpoint between said opposite ends, and an inside surface facing the user and an outside surface facing away from the user, an adjustable closure means attached to said elongated belt for reversibly and adjustably articulating said opposite ends of said elongated belt, thereby reversibly creating an enclosed belt with an adjustable circumference, a pair of cargo-carrying means attached to said outside surface of said elongated belt for releasably attaching carded equipment to said elongated belt, at least one of said pair of cargo-carrying means is attached to a position lockable sliding means for adjustably sliding and securing the cargo-carrying means to any available point on said elongated belt, a first of said pair of cargo-carrying means attached to said elongated belt substantially near a first of said opposite ends thereof defines a short and a long portion on said elongated belt, said long portion intermediate between said first cargo-carrying means and a second of said opposite ends, said short portion intermediate between said first cargo-carrying means and said first end, a second of said pair of cargo-carrying means is attached to said long portion of said elongated belt via said position lockable sliding means and is thereby allowed to adjustably slide and secure to any given point included on said long portion of said elongated belt, whereby said accessory is transformable or interchangeable between a waist belt with said elongated belt worn around the waist of the user and an equipment carrying sling with said elongated belt worn over a first of a pair of opposite shoulders provided by the user, whereby said accessory further including a modified shoulder pad comprised of a shoulder pad attached to a storage bag, mounted on said elongated belt such that said shoulder pad is positioned on said inside surface of said elongated belt and said storage bag is positioned on said outside surface of said elongated belt.

2. The accessory of claim 1 wherein said equipment carrying sling is configured and wearable by the user in two alternative configurations.

3. The accessory of claim 2 wherein a first of said two alternate configurations, positions said long portion of said elongated belt substantially near said midpoint thereof over said first shoulder of user thereby disposing said first and second opposite ends of said elongated belt on opposite dorsal and ventral sides of the user.

4. The accessory of claim 3 wherein said adjustable closure means connect said opposite ends disposed on the dorsal and ventral side of the user under a second of said opposite shoulders provided by the user, thereby forming said enclosed belt with said adjustable circumference around the torso of the user, thereby stabilizing said equipment carrying sling around the torso of the user.

5. The accessory of claim 3 wherein said position lockable sliding means slidably articulating said second cargo-carrying means to said long portion of said elongated belt is disposed at a position intermediate between said midpoint and said second end contained in said long portion, thereby disposing said first and second cargo-carrying means on opposite dorsal and ventral sides of the user.

6. The accessory of claim 5 wherein said cargo-carrying means reversibly attachable and detachable to carded equipment on the dorsal and ventral sides of the user thereby balancing carded equipment over said first shoulder of the user.

7. The accessory of claim 2 wherein a second of said two alternate configurations positions said short portion of said elongated belt on the dorsal side of the user near said first shoulder, said long portion is positioned over said first shoulder of the user, across the ventral side of the user's torso, and around the user's lateral side under the user's said second shoulder, towards the user's dorsal side, said position lockable sliding means slidably articulating said second cargo means to said long portion of said elongated belt being disposed substantially near said second opposite end, thereby positioning both cargo-carrying means on the user's dorsal side.

8. The accessory of claim 7 wherein said cargo-carrying means reversibly attachable to carded equipment from opposite lateral sides on the equipment and position carded equipment in an upright manner parallel to and along the user's dorsal side thereby strapping carded equipment to the user's dorsal side.

9. The accessory of claim 7 wherein, said accessory adapted in said second alternate configuration is alternately arranged on the user such that said long portion of said elongated belt substantially near the midpoint thereof, is positioned around the neck of the user, said opposite ends of said elongated belt being disposed on the user's ventral side, thereby disposing said first and second cargo-carrying means on the ventral side of the user.

10. The accessory of claim 1 further including a plurality of securing means for securing said first and second cargo-carrying means to said modified shoulder pad, said plurality of securing means being attached to and distributed along said modified shoulder pad.

11. The accessory of claim 1 wherein said modified shoulder pad provides a storage bag which is accessible to the user in both said waist belt and said sling.

12. The accessory of claim 1 wherein said modified shoulder pad provides a shoulder pad positioned over said first shoulder when said accessory is adapted to use as said sling conformation.

13. The accessory of claim 1 further including, a pair of first and second secondary equipment securing means for attaching secondary equipment to said modified shoulder pad, said first and second securing means being attached near the midpoint of the modified shoulder pad.

14. A combination equipment carrying sling/waist belt accessory, comprising an elongated belt, made of flexible material having a length defined by two opposite ends, said length containing a midpoint between said opposite ends, and an inside surface facing the user and an outside surface facing away from the user, an adjustable closure means attached to said elongated belt for reversibly and adjustably articulating said opposite ends of said elongated belt, thereby reversibly creating an enclosed belt with an adjustable circumference, a pair of cargo-carrying means attached to said outside surface of said elongated belt for releasably attaching carded equipment to said elongated belt, a first of said pair of cargo-carrying means attached to said elongated belt substantially near a first of said opposite ends thereof defines a short and a long portion on said elongated belt, said long portion intermediate between said first cargo-carrying means and a second of said opposite ends, said short portion intermediate between said first cargo-carrying means and said first end, a modified cam buckle containing two elongated apertures in its base piece, a first of said elongated apertures slidably attaches said modified cam buckle to said long portion of said elongated belt, a second of said elongated apertures of said modified cam buckle located on said outside surface of said elongated belt securely attaches a second of said pair of cargo-carrying means, thereby said modified cam buckle is disposed and secured along any given point contained in said long portion of said elongated belt, a modified shoulder pad means for providing a storage bag for extra storage space as well as a shoulder pad for cushioned support along said elongated belt, said modified shoulder pad means being mounted on said elongated belt such that said shoulder pad is positioned on said inside surface and said storage bag is positioned on said outside surface of said elongated belt, a plurality of securing means for securing said first and second cargo-carrying means to said modified shoulder pad, said plurality of securing means being attached to and distributed along said modified shoulder pad, whereby said accessory is transformable or interchangeable between a waist belt with said elongated belt worn around the waist of the user and an equipment carrying sling with said elongated belt worn over a first of a pair of opposite shoulders provided by the user.

15. The accessory of claim 14 further including, a pair of first and second secondary equipment securing means for attaching secondary equipment to said modified shoulder pad means, said first and second securing means being attached near the midpoint of said modified shoulder pad means.

16. The accessory of claim 14 wherein said accessory is utilized and adapted to be worn by the user in either a waist belt or a sling conformation, said waist belt conformation yields a waist belt with said adjustable closure means articulating said opposite ends around the waist of the user thereby forming said enclosed belt with said adjustable circumference around the waist thereof, said sling conformations yields an equipment carrying sling with said elongated belt positioned over said first of two opposite shoulders provided by the user.

17. The accessory of claim 16 wherein said accessory is configured and worn by the user in two alternative configurations, a first of said two alternate configurations, positions said long portion of said elongated belt substantially near said midpoint thereof over said first shoulder of user thereby disposing said first and second opposite ends of said elongated belt on opposite dorsal and ventral sides of the user, said modified cam buckle being disposed at a position intermediate between said midpoint and said second opposite end contained in said long portion, thereby disposing said first and second cargo-carrying means on opposite dorsal and ventral sides of the user, a second of said two alternate configurations positions said elongated belt such that said short portion is positioned on the dorsal side of the user near said first shoulder, said long portion is positioned over said first shoulder of the user, across the ventral side of the user's torso, and around the user's lateral side under the user's said second shoulder, towards the user's dorsal side, said modified cam buckle being positioned substantially near said second opposite end, thereby positioning both cargo-carrying means on the users dorsal side.

18. The accessory of claim 17 wherein, said accessory adapted in said second alternate configuration is alternately arranged on the user such that said long portion of said elongated belt substantially near the midpoint thereof is positioned around the neck of the user, said opposite ends of said elongated belt being disposed on the user's ventral side, thereby disposing said first and second cargo-carrying means on the ventral side of the user.

* * * * *